US009144117B2

(12) United States Patent
Kimrey, Jr. et al.

(10) Patent No.: US 9,144,117 B2
(45) Date of Patent: Sep. 22, 2015

(54) MICROWAVE BARRIER SYSTEM FOR USE IN HEATING ARTICLES UNDER VACUUM

(75) Inventors: Harold Dail Kimrey, Jr., Knoxville, TN (US); David Carl Attride, Jonesborough, TN (US); Brad William Overturf, Kingsport, TN (US)

(73) Assignee: Eastman Chemical Company, Kingsport, TN (US)

( * ) Notice: Subject to any disclaimer, the term of this patent is extended or adjusted under 35 U.S.C. 154(b) by 717 days.

(21) Appl. No.: 13/323,582

(22) Filed: Dec. 12, 2011

(65) Prior Publication Data

US 2012/0181267 A1 Jul. 19, 2012

Related U.S. Application Data

(60) Provisional application No. 61/427,038, filed on Dec. 23, 2010, provisional application No. 61/427,047, filed on Dec. 23, 2010.

(51) Int. Cl.

| | |
|---|---|
| ***H05B 6/64*** | (2006.01) |
| ***H05H 1/46*** | (2006.01) |
| ***C23C 16/20*** | (2006.01) |
| ***H05B 6/80*** | (2006.01) |
| ***H05B 6/70*** | (2006.01) |

(52) U.S. Cl.
CPC ..... *H05B 6/802* (2013.01); *H05B 6/701* (2013.01); *H05B 6/707* (2013.01)

(58) Field of Classification Search
CPC ..... H05B 6/701; H05B 6/802; H05B 6/707
USPC ..... 219/756, 679, 762, 694–696, 698–699, 219/684, 687, 739–741; 118/723 MW, 118/723 MP, 723 ME; 315/111.21; 156/345.42; 427/542
See application file for complete search history.

(56) References Cited

U.S. PATENT DOCUMENTS

| | | | | |
|---|---|---|---|---|
| 5,433,790 | A * | 7/1995 | Niino et al. | 118/723 MW |
| 6,740,848 | B2 | 5/2004 | Parker | |
| 7,498,548 | B2 | 3/2009 | Opperman | |
| 2007/0215612 | A1 | 9/2007 | Hicks et al. | |

FOREIGN PATENT DOCUMENTS

| | | | |
|---|---|---|---|
| JP | 06045098 | A * | 2/1994 |
| JP | 2007149404 | A | 6/2007 |

OTHER PUBLICATIONS

International Search Report and Written Opinion (SRI/WO) for PCT Application No. PCT/US2011/065872 . . . Microwave Barrier System for Use in Heating Articles Under Vacuum; International Filing Date: Dec. 19, 2011; Applicant: Microwave Materials Technologies, Inc.; SR/WO dated Aug. 24, 2012; 10 pages.

* cited by examiner

*Primary Examiner* — Quang Van
(74) *Attorney, Agent, or Firm* — Hovey Williams LLP

(57) ABSTRACT

An optimized microwave barrier assembly suitable for use with a vacuum microwave heater. The barrier assembly is configured to allow microwaves to pass therethrough in a $TM_{ab}$ mode, wherein a is 0 and b is an integer in the range of 1 to 5. The barrier assembly is also configured to maintain a pressure differential across a window of the barrier assembly. Such a configuration can reduce or eliminate arcing in the barrier assembly, even at low pressures.

10 Claims, 15 Drawing Sheets

MICROWAVE BARRIER SYSTEM FOR USE IN HEATING ARTICLES UNDER VACUUM

CROSS-REFERENCE TO RELATED APPLICATIONS

This application claims priority to U.S. Provisional Patent Application Nos. 61/427,038 and 61/427,047, filed on Dec. 23, 2010.

FIELD OF THE INVENTION

This invention relates to microwave systems for heating one or more articles, objects, and/or loads.

BACKGROUND

Electromagnetic radiation, such as microwave radiation, is a known mechanism for delivering energy to an object. The ability of electromagnetic radiation to penetrate and heat an object both rapidly and effectively has proven advantageous in many chemical and industrial processes. Further, because the use of microwave energy as a heat source is generally non-invasive, microwave heating is particularly useful in processing 'sensitive' dielectric materials, such as food and pharmaceuticals, and can even be useful for heating materials having a relatively poor thermal conductivity. However, the complexities and nuances of safely and effectively applying microwave energy, especially on a commercial scale, have severely limited its application in several types of industrial processes.

Thus, a need exists for an efficient and cost effective industrial-scale microwave heating system suitable for use in a wide variety of processes and applications.

SUMMARY

One embodiment of the present invention concerns a barrier assembly for permitting passage of microwave energy therethrough in a predominately $TM_{ab}$ mode while inhibiting fluid flow therethrough. The barrier assembly comprises a substantially cylindrical entry section configured to propagate microwave energy in a predominately $TM_{ab}$ mode, a substantially cylindrical exit section configured to propagate microwave energy in a predominately $TM_{ab}$ mode, and at least one sealed window member disposed between the entry and exit sections. The at least one sealed window member is configured to permit passage of microwave energy therethrough in at predominately $TM_{ab}$ mode while maintaining a pressure differential across the at least one sealed window member, wherein a is 0 and b is in the range of 1 to 5.

Another embodiment of the present invention concerns a microwave heating system comprising at least one microwave generator for generating microwave energy, a microwave heater defining an interior for receiving at least a portion of the microwave energy, a microwave distribution system for directing microwave energy from the at least one generator to the interior of the microwave heater. The microwave distribution system comprises a first $TM_{ab}$ waveguide, a second $TM_{ab}$ waveguide, and a $TM_{ab}$ barrier assembly coupled to and disposed between the first and second $TM_{ab}$ waveguides, wherein a is 0 and b is in the range of from 1 to 5. The $TM_{ab}$ barrier assembly comprises at least one sealed window member for fluidly isolating the first and second $TM_{ab}$ waveguides from each other while permitting passage of at least a portion of the microwave energy from the first $TM_{ab}$ waveguide to second $TM_{ab}$ waveguide.

Still another embodiment of the present invention concerns a microwave heating system comprising at least one microwave generator for generating microwave energy, a microwave heater for receiving at least a portion of the microwave energy, a microwave distribution system for directing at least a portion of the microwave energy from the at least one microwave generator to the interior of the microwave heater. The microwave distribution system comprises a first mode converter, a second mode converter, and a $TM_{ab}$ barrier assembly disposed therebetween, wherein a is 0 and b is an integer between 1 and 5. The total electrical length between the first mode converter and the second mode converter extending through and including the electrical length of the $TM_{ab}$ barrier assembly is equal to a non-integral number of half-wavelengths of a competing mode of microwave energy passing through the $TM_{ab}$ barrier assembly.

Yet another embodiment of the present invention concerns a microwave heating process comprising: (a) generating microwave energy; (b) directing at least a portion of the microwave energy to a microwave heater, wherein the directing includes passing at least a portion of the microwave energy through a barrier assembly in $TM_{ab}$ mode while a pressure differential is maintained across the barrier assembly, wherein a is 0 and b is an integer in the range of 1 to 5; and (c) simultaneously with step (b), heating one or more articles in the microwave heater with at least a portion of the microwave energy passed through the barrier assembly.

DETAILED DESCRIPTION

In accordance with one embodiment of the present invention, a heating system is provided. Heating systems configured according to various embodiments of the present invention can comprise a heat source, a heating vessel (e.g., a heater), and an optional vacuum system. Typically, heating systems configured according to one embodiment of the present invention can be suitable for use as stand-alone heating units, or can be employed as, or in conjunction with, chemical reactors in a variety of processes. Heating systems configured according to several embodiments of the present invention will now be described in detail below, with reference to the Figures.

Figure 1:
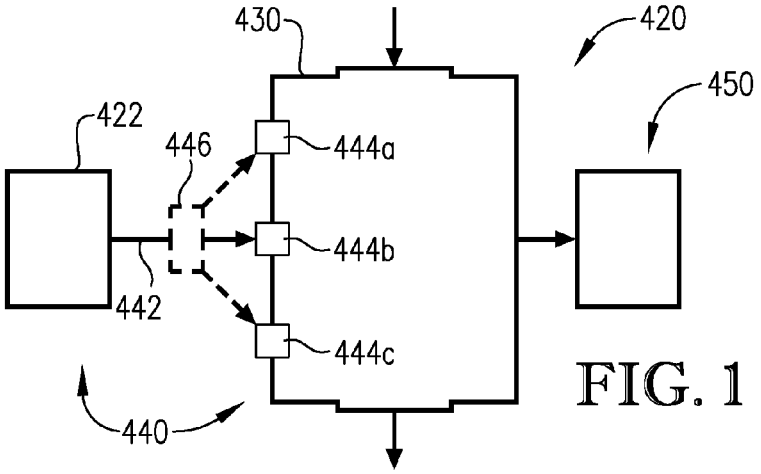
FIG. 1 is a schematic view of a microwave heating system configured in accordance with one embodiment of the present invention, particularly illustrating a microwave heater that is equipped with a vacuum system and receives microwave energy from a microwave generator via a microwave distribution system.

Turning now to FIG. 1, a microwave heating system 420 configured according to one embodiment of the present invention is illustrated as comprising at least one microwave generator 422, a microwave heater 430, a microwave distribution system 440, and an optional vacuum system 450. Microwave energy produced by microwave generator 422 can be directed to microwave heater 430 via one or more components of microwave distribution system 440. Additional details regarding components and operation of microwave distribution system 440 will be discussed in detail shortly. When present, vacuum system 450 can be operable to reduce the pressure in microwave heater 430 to no more than about 550 torr, no more than about 450 torr, no more than about 350 torr, no more than about 250 torr, no more than about 200 torr, no more than about 150 torr, no more than about 100 torr, or no more than about 75 torr. In one embodiment, the vacuum system can be operable to reduce the pressure in microwave heater 430 to no more than about 10 millitorr ($10^{-3}$ torr), no more than about 5 millitorr, no more than about 2 millitorr, no more than about 1 millitorr, no more than about 0.5 millitorr, or no more than about 0.1 millitorr. Each of the components of microwave heating system 420 will now be discussed in detail below.

Microwave generator 422 can be any device capable of producing or generating microwave energy. As used herein, the term "microwave energy" refers to electromagnetic energy having a frequency between 300 MHz and 30 GHz. As used herein, the term "between" when used in a range is intended to encompass both endpoints. For example, if a value is "between x and y," the value can be x, y, or any intervening value. In one embodiment, various configurations of microwave heating system 420 can utilize microwave energy having a frequency of about 915 MHz or a frequency of about 2.45 GHz, both of which have been generally designated as industrial microwave frequencies. Examples of suitable types of microwave generators can include, but are not limited to, magnetrons, klystrons, traveling wave tubes, and gyrotrons. In various embodiments, one or more microwave generators 422 can be capable of delivering (e.g., have a maximum output of) at least about 5 kW, at least about 30 kW, at least about 50 kW, at least about 60 kW, at least about 65 kW, at least about 75 kW, at least about 100 kW, at least about 150 kW, at least about 200 kW, at least about 250 kW, at least about 350 kW, at least about 400 kW, at least about 500 kW, at least about 600 kW, at least about 750 kW, or at least about 1,000 kW and/or not more than about 2,500 kW, not more than about 1,500 kW, or not more than about 1,000 kW. Although illustrated as comprising one microwave generator 422, microwave heating system 420 can comprise two or more microwave generators configured to operate in a similar manner.

Microwave heater 430 can be any device capable of receiving and heating one or more articles using microwave energy. In one embodiment, at least about 75 percent, at least about 85 percent, at least about 95 percent, or substantially all of the heat or energy provided by microwave heater 430 can be provided by microwave energy. Microwave heater 430 can also be used as a microwave dryer, which can be further operable to dry one or more items disposed therein using microwave energy as described herein.

Figure 2:
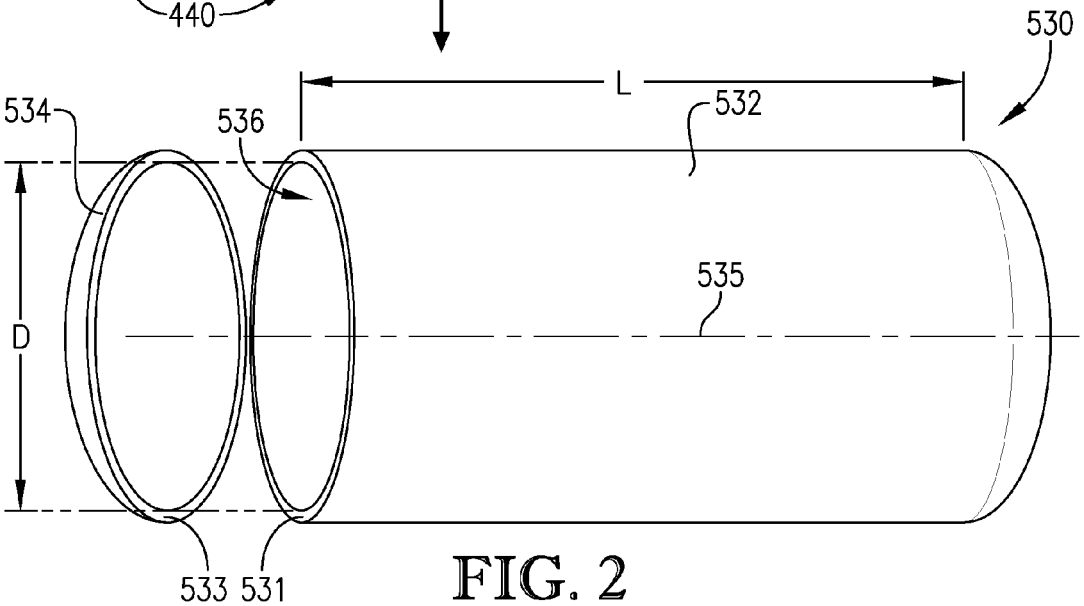
FIG. 2 is an isometric view of a microwave heater in accordance with various embodiments of the present invention, particularly illustrating the shape and dimensional proportions of the vessel.

Turning now to FIG. 2, one embodiment of a microwave heater 530 is illustrated as comprising a vessel body 532 and a door 534 for selectively permitting and blocking the access to or passage of one or more objects (not shown) into and out of the interior 536 of microwave heater 530. In one embodiment, vessel body 532 of microwave heater 530 can be elongated along a central axis of elongation 535, which can be oriented in a substantially horizontal direction, as illustrated in FIG. 2. Vessel body 532 can have a cross-section of any suitable shape or size. In one embodiment, the cross-section of vessel 532 can be substantially circular or round, while, in another embodiment, the cross-section can be elliptical. According to one embodiment, the size and/or shape of the cross-section of vessel body 532 can change along the direction of elongation, while, in another embodiment, the shape and/or size of its cross-section can remain substantially the same. In the embodiment depicted in FIG. 2, vessel body 532 of microwave heater 530 comprises a horizontally elongated, cylindrical vessel body having a circular cross-section.

Microwave heater 530 can have an overall maximum internal dimension or length, L, and a maximum inner diameter, D, as shown in FIG. 2. In one embodiment, L can be at least about 8 feet, at least about 10 feet, at least about 16 feet, at least about 20 feet, at least about 30 feet, at least about 50 feet, at least about 75 feet, at least about 100 feet and/or no more than about 500 feet, no more than about 350 feet, no more than about 250 feet. In another embodiment, D can be at least about 3 feet, at least about 5 feet, at least about 10 feet, at least about 12 feet, at least about 18 feet, at least about 20 feet, at least about 25 feet, or at least about 30 feet and/or no more than about 25 feet, no more than about 20 feet, or no more than about 15 feet. In one embodiment, the ratio (L:D) of the length of microwave heater 530 to its inner diameter (L:D) can be at least about 1:1, at least about 2:1, at least about 3:1, at least about 4:1, at least about 6:1, at least about 8:1, at least about 10:1 and/or no more than about 50:1, no more than about 40:1, or no more than about 25:1.

Microwave heater 530 can be constructed out of any suitable material. In one embodiment, microwave heater 530 can comprise at least one electrically conductive and/or highly reflective material. Examples of suitable materials can include, but are not limited to, selected carbon steels, stainless steels, nickel alloys, aluminum alloys, and copper alloys. Microwave heater 530 can be almost completely constructed out of a single material, or multiple materials can be used to construct various portions of microwave heater 530. For example, in one embodiment, microwave heater 530 can be constructed of a first material and can then be coated or layered with a second material on at least a portion of its interior and/or exterior surface. In one embodiment, the coating or layer can comprise one or more of the metals or alloys listed above, while, in another embodiment, the coating or layer can comprise glass, polymer, or other dielectric material.

Microwave heater 530 can define one or more spaces suitable for receiving a load. The load can be positioned within interior 536 of microwave heater 530 in a static or dynamic manner. For example, in one embodiment wherein the load is statically positioned in microwave heater 530, the load can be relatively motionless during heating and may be held in place using static positioning devices (not shown) such as, for example, a shelf, a platform, a parked cart, a stopped belt, or the like. In another embodiment wherein the load is dynamically positioned within microwave heater 530, the load can be in motion during at least a portion of heating using one or more dynamic positioning devices (not shown) during heating. Examples of dynamic positioning devices can include, but are not limited to, continuous moving belts, rollers, horizontally and/or vertically oscillating platforms, and rotating platforms. In one embodiment, one or more dynamic positioning devices may be used in a generally continuous process, while one or more static positioning devices may be employed in a batch or semi-batch process.

According to one embodiment of the present invention, microwave heater 530 can also comprise one or more sealing mechanisms to reduce, inhibit, minimize, or substantially prevent the leakage of fluids and/or microwave energy into or out of the vessel interior 536 during treatment. As illustrated in FIG. 2, vessel body 532 and door 534 can each present respective body-side and door-side sealing surfaces 531, 533. In one embodiment, body-side and door-side sealing surfaces 531, 533 can directly or indirectly form a fluid seal between door 534 and vessel body 532 when door 534 is closed. A direct seal can be formed when at least a portion of body-side and door-side sealing surfaces 531, 533 make direct physical contact with one another. An indirect seal can be formed between door 534 and vessel body 532 when one or more resilient sealing members for fluidly isolating the interior of microwave heater 530 from an external environment (not shown in FIG. 2) are at least partially compressed against door-side and/or body-side sealing surfaces 533, 531 when door 534 is closed. Examples of resilient sealing members can include, but are not limited to, o-rings, spiral wound gaskets, sheet gaskets, and the like. According to one embodiment, the direct or indirect seal formed between vessel body 532 and door 534 can be such that microwave heater 530 can have a fluid leak rate of no more than about $10^{-2}$ torr liters/sec, no more than about $10^{-4}$ torr liters/sec, or no more than about $10^{-8}$ torr liters/sec at or near the junction of body 532 and door 534, when subjected to a helium leak test conducted according to procedure B1 entitled "Spraying Testing" described in the document entitled "Helium Leak Detection Techniques" published by Alcatel Vacuum Technology using a Varian Model No. 938-41 detector. In one embodiment, fluid seal can be particularly useful when the environment inside microwave heater 530 comprises a sub-atmospheric and otherwise challenging process environment.

Microwave heaters configured according to one embodiment of the present invention can also comprise a microwave choke for inhibiting or substantially preventing microwave energy leakage between door 534 and vessel body 532 of microwave heater 530 when door 534 is closed (e.g., at or near the junction of door 534 and vessel body 532). As used herein, the term "choke" refers to any device or component of a microwave vessel operable to reduce the amount of energy leaking from or escaping the vessel during the application of microwave energy. In one embodiment, the choke can be any device operable to reduce the amount of microwave leakage from the vessel by at least about 25 percent, at least about 50 percent, at least about 75 percent, or at least about 90 percent as compared to when a choke is not employed. In one embodiment of the present invention, the microwave choke can be operable to allow no more than about 50 milliwatts per square centimeter ($mW/cm^2$), no more than about 25 $mW/cm^2$, no more than about 10 $mW/cm^2$, no more than about 5 $mW/cm^2$, or no more than about 2 $mW/cm^2$ of microwave energy to leak out of the heater through the choke when measured 5 cm from the vessel with a Narda Microline Model 8300 broad band isotropic radiation monitor (300 MHz to 18 GHz).

Further, in contrast to conventional microwave chokes, which often fail when subjected to sub-atmospheric pressures, microwave chokes configured according to one embodiment of the present invention can be operable to substantially inhibit microwave energy leakage, even under deep vacuum conditions. For example, in one embodiment, a microwave choke as described herein can inhibit microwave energy leakage from the heater to the extent described above when the pressure in the microwave heater is no more than about 550 torr, no more than about 450 torr, no more than about 350 torr, no more than about 250 torr, no more than about 200 torr, no more than about 100 torr, or no more than about 75 torr. In one embodiment, a microwave choke as described herein can inhibit microwave energy leakage from the heater to the extent as described above when the pressure in the microwave heater is no more than about 10 millitorr ($10^{-3}$ torr), no more than about 5 millitorr, no more than about 2 millitorr, no more than about 1 millitorr, no more than about 0.5 millitorr, or no more than about 0.1 millitorr. Further, a microwave choke according to one embodiment of the present invention can maintain its level of leakage prevention on large-scale units, such as, for example, microwave heaters having a microwave energy input rate of at least about 5 kW, at least about 30 kW, at least about 50 kW, at least about 60 kW, at least about 65 kW, at least about 75 kW, at least about 100 kW, at least about 150 kW, at least about 200 kW, at least about 250 kW, at least about 350 kW, at least about 400 kW, at least about 500 kW, at least about 600 kW, at least about 750 kW, or at least about 1,000 kW and/or not more than about 2,500 kW, not more than about 1,500 kW, or not more than about 1,000 kW.

In one embodiment, substantially no arcing can occur near the choke 650 while microwave energy is introduced into the vessel (e.g., during the heating step), even at the levels of microwave energy and vacuum pressure described above. As used herein, the term "arcing", refers to undesired, uncontrolled electrical discharge, at least partially caused by ionization of a surrounding fluid. Arcing, which can damage equipment and materials and poses a substantial fire or explosion hazard, has a lower threshold at lower pressures, especially sub-atmospheric (e.g., vacuum) pressures. Typically, conventional systems limit rate of energy input in order to minimize or avoid arcing. In contrast to conventional systems, however, microwave heaters configured according to embodiments of the present invention can be operable to receive microwave energy at a rate of at least about 5 kW, at least about 30 kW, at least about 50 kW, at least about 60 kW, at least about 65 kW, at least about 75 kW, at least about 100 kW, at least about 150 kW, at least about 200 kW, at least about 250 kW, at least about 350 kW, at least about 400 kW, at least about 500 kW, at least about 600 kW, at least about 750 kW, or at least about 1,000 kW and/or not more than about 2,500 kW, not more than about 1,500 kW, or not more than about 1,000 kW can be introduced into a microwave heater (optionally referred to as a vacuum microwave heater or a vacuum microwave dryer) when the pressure is no more than about 550 torr, no more than about 450 torr, no more than about 350 torr, no more than about 250 torr, no more than about 200 torr, no more than about 100 torr, no more than about 75 torr, no more than about 10 millitorr ($10^{-3}$ torr), no more than about 5 millitorr, no more than about 2 millitorr, no more than about 1 millitorr, no more than about 0.5 millitorr, or no more than about 0.1 millitorr and/or at least about 50 torr or at least about 75 torr with substantially no arcing at or near the choke.

Figure 3A:
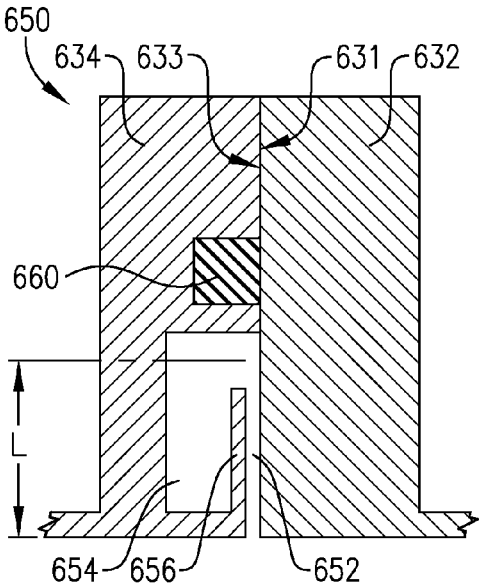
FIG. 3*a* is a partial sectional view of the junction of a door flange and a vessel flange of a microwave heater configured in accordance with one embodiment of the present invention, particular illustrating a microwave choke cooperatively formed by the door and vessel flanges and having two chambers that extend parallel to and alongside one another.

Referring now to FIG. 3*a*, a cross-sectional segment of one embodiment of a microwave choke 650 for substantially inhibiting microwave energy leakage between a door 634 and a vessel body 632 of a microwave heater when door 634 is closed is provided. As shown in FIG. 3*a*, at least a portion of microwave choke 650 is cooperatively defined or formed between door 634 and vessel body 632 when door 634 is closed and respective door-side 633 and body-side 631 sealing surfaces are in direct or indirect contact with one another. In one embodiment, an optional fluid sealing member 660 can also be present to inhibit, minimize, or substantially prevent leakage of fluid into or out of the microwave heater, as discussed previously. Fluid sealing member 660, when present, can be coupled to vessel body 632 or, as shown in FIG. 3*a*, to door 634.

According to one embodiment shown in FIG. 3*a*, microwave choke 650 defines a first radially-extending choke cavity 652, a second-radially extending choke cavity 654, and a radially-extending choke guidewall 656 disposed at least partly between first and second choke cavities 652, 654 when the door 634 of the microwave heater is closed. In one embodiment illustrated in FIG. 3*a*, first choke cavity 652 is defined between vessel body 632 and choke guidewall 656 when door 634 is closed, while second choke cavity 654 is at least partially disposed between door 634 and choke guidewall 656, such that choke guidewall 656 is substantially coupled to door 634. First choke cavity 652 can be open to the interior of the microwave heater and can be radially positioned between the interior of the microwave heater and the fluid seal created by sealing member 660, when present. In another embodiment of the present invention (not shown in FIG. 3*a*), second choke cavity 654 can be at least partially defined by vessel body 632, such that second choke cavity 654 can be positioned between vessel body 632 and choke guidewall 656 when door 634 is closed, such that choke guidewall 656 is substantially coupled to vessel body 632.

In one embodiment, at least a portion of second choke cavity 654 can extend alongside at least a portion of first choke cavity 652 when door 634 is closed. In one embodiment, at least about 40 percent, at least about 60 percent, at least about 80 percent, or at least about 90 percent of the total length of second choke cavity 654 can extend alongside first choke cavity 654 when door 634 is closed. The total length of first and/or second choke cavities 652, 654, designated with the letter "L" in FIG. 3*a*, can be at least about 1/16 times, at least about 1/8 times, at least about 1/4 times and/or no more than about 1 times, no more than about 3/4 times, or no more than about 1/2 times the length of the predominant wavelength of the microwave energy in the interior of the microwave heater. The length, L, of first and/or second choke cavities 652, 654 can be at least about 1 inch, at least about 1.5 inches, at least about 2 inches, or at least about 2.5 inches and/or no more than about 8 inches, no more than about 6 inches, or no more than about 5 inches.

Figure 3B:
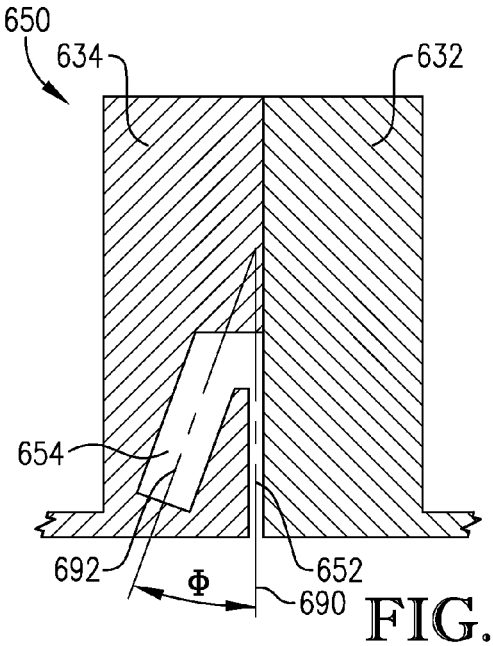
FIG. 3*b* is a partial sectional view of a microwave choke similar the choke depicted in FIG. 3*a*, but having choke cavities that extend at an acute angle relative to one another.

As illustrated in FIG. 3*b*, a relative extension angle, $\phi$, can be defined between the direction of extension of first choke cavity 652, designated by line 690, and the direction of extension of second choke cavity 654, designated by line 692. In various embodiments, the relative extension angle, $\phi$, can be no more than about 60°, no more than about 45°, no more than about 30°, or no more than about 15°. In some embodiments, the direction of extension of second choke cavity 654 can be substantially parallel to the direction of extension of first choke cavity 652, as depicted in FIG. 3*a*.

Figure 3C:
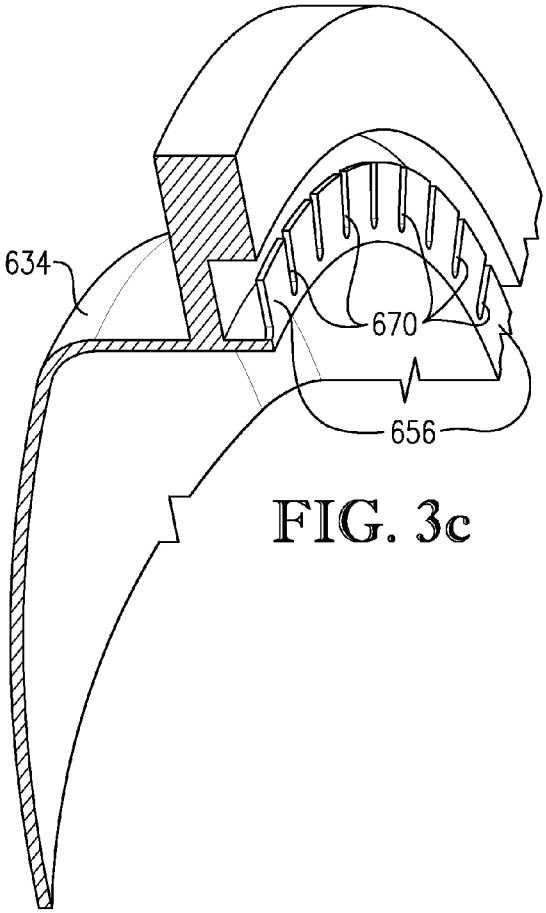
FIG. 3*c* is a cut-away isometric view of the door flange of a microwave heater equipped with the microwave choke configuration depicted in FIG. 3*a*, particularly illustrating a plurality of circumferentially-spaced, open-ended slots or gaps formed in a guidewall of the choke.

Referring now to FIG. 3*c*, a partial isometric cross-sectional portion of a microwave choke is provided. As shown in FIG. 3*c*, choke guidewall 656 can be integrally formed into door 634. According to one embodiment, guidewall 656 can comprise a plurality of spaced open-ended gaps 670 disposed circumferentially along guidewall 656. In one embodiment, the spacing between the centerline of each of the gaps can be at least about 0.5 inches, at least about 1 inch, at least about 2 inches, or at least about 2.5 inches and/or no more than about 8 inches, no more than about 6 inches, or no more than about 5 inches.

Figure 3E:
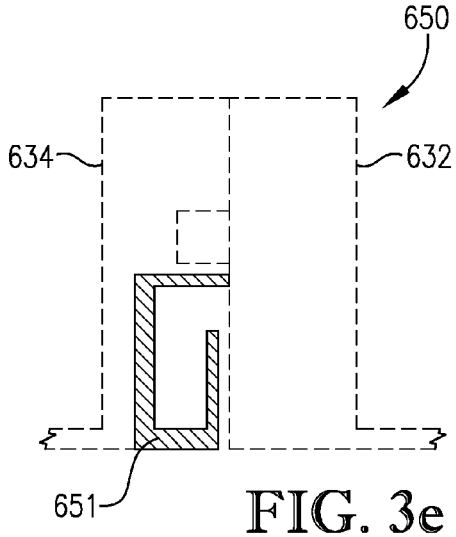
FIG. 3*e* is a sectional view of a "G"-shaped removable choke portion previously depicted in FIG. 3*d;*
Figure 3F:
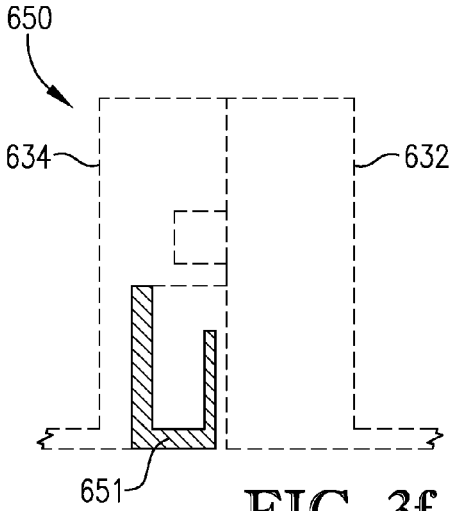
FIG. 3*f* is a sectional view of a "J"—or "U"-shaped removable choke portion configured in accordance with a first alternative embodiment of the present invention.
Figure 3G:
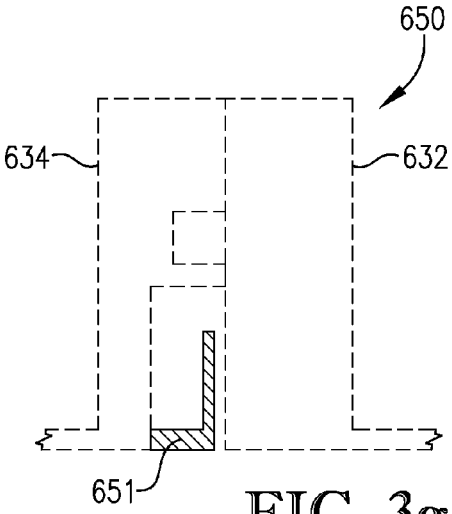
FIG. 3*g* is a sectional view of an "L"-shaped removable choke portion configured in accordance with a second alternative embodiment of the present invention.
Figure 3H:
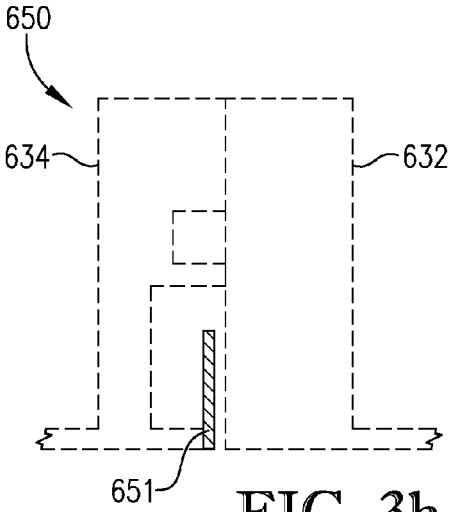
FIG. 3*h* is a sectional view of an "I"-shaped removable choke portion configured in accordance with a third alternative embodiment of the present invention.
Figure 3D:
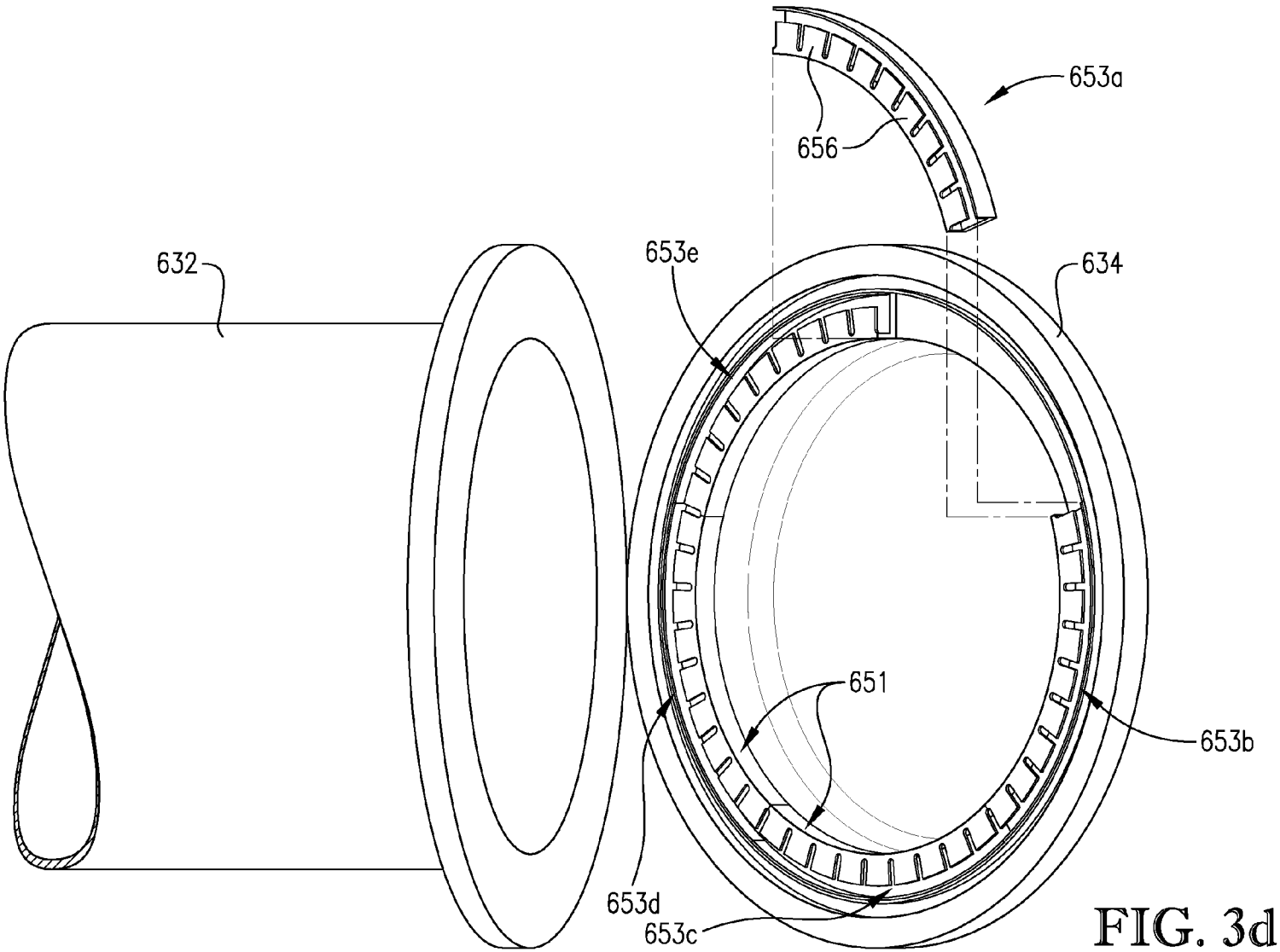
FIG. 3*d* is a side view of an open door on a microwave heater equipped with a microwave choke having a removable portion configured in accordance with one embodiment of the present invention, particularly illustrating that the removable portion of the microwave choke comprises a plurality of individually removable and replaceable choke segments.

According to another embodiment of the present invention, at least a portion of choke 650 can comprise a removable portion 651 removably coupled to vessel body 632 or door 634. In one embodiment, removable portion 651 can be removably coupled to door 634. As used herein, the term "removably coupled" means attached in a manner such that a portion of the choke can be removed without substantial damage to or destruction of the vessel body, the choke, and/or the door. In one embodiment, removable choke portion 651 can comprise at least a portion or all of guidewall 656. FIG. 3*d* illustrates a microwave choke having at least one removable portion 651. In one embodiment depicted in FIG. 3*d*, guidewall 656 can be coupled to removable choke portion 651. Removable choke portion 651 can comprise a plurality of removable choke segments 653*a-e* that are each removably coupled to door 634 or vessel body 632 (embodiment not shown). In one embodiment, removable choke portion 651 can comprise at least 2, at least 3, at least 4, at least 6, at least 8 and/or no more than 16, no more than 12, no more than 10, or no more than 8 removable choke segments 653. According to one embodiment wherein removable choke portion 651 has a generally ring-shaped diameter, individually removable choke segments 653*a-e* can have a generally arcuate shape, as shown in FIG. 3*d*.

Removable choke portion 651 can be fastened to door 634 or vessel body 632 according to any known method including, for example, bolts, screws, or any other type of suitable removable fastening device. In one embodiment, removable choke portion 651 can be magnetically fastened to door 634 or vessel body 632. Depending, in part, on the desired method of fastening, removable choke portion 651 can have a variety of cross-sectional shapes. For example, as illustrated in FIGS. 3*e-h*, removable choke portion 651 can define a cross-section which is generally G-shaped (as shown in FIG. 3*e*), generally J-shaped or U-shaped (as shown in FIG. 3*f*), generally L-shaped (as shown in FIG. 3*g*), or generally I-shaped (as shown in FIG. 3*h*).

In operation, removable choke portion 651 can be attached, removed, and/or subsequently replaced without removing portions of or substantially re-machining vessel body 632 and/or door 634 in order to resume normal operation of the microwave heater. For example, in one embodiment, a plurality of individually removable choke segments 653*a-e* can be separately and individually attached to door 634 and/or vessel body 632. Subsequently, when one or more portions of the microwave choke become damaged or otherwise require replacement, one or more individually removable choke segments 653 and/or the entire removable choke portion 651 can be separately and individually detached or removed from vessel body 632 or door 634 and replaced with one or more new (e.g., replacement) removable choke segments 653 and/or a new removable choke portion 651. In one embodiment, the number of removable choke segment or segments 653*a, b, c, d*, and/or *e* detached from and then reattached to (e.g., removed from and replaced onto) vessel body 632 or door 634 can be not more than or no more than the total number of choke segments 653*a-e* of removable portion 651.

Microwave heater 530, generically represented in FIG. 2, can be classified as a single mode cavity, a multi-mode cavity, or a quasi-optical cavity depending on how the microwave energy therein behaves. As used herein, the term "single mode cavity" refers to a cavity designed and operated to maintain the microwave energy therein a single, specific mode pattern. Oftentimes, the design and properties of a single mode cavity can limit the size of the vessel and/or how a load can be positioned within the chamber. As a result, in one embodiment, microwave heater 530 can comprise a multimode or a quasi-optical mode cavity. As used herein, the term "multimode cavity" refers to a cavity or chamber wherein the microwave energy is excited into a plurality of standing wave patterns in a semi-random or undirected manner. As used herein, the term "quasi-optical mode cavity" refers to a cavity or chamber wherein most, but not all, of the energy is directed toward a particular area in a controlled manner. In one embodiment, a multimode cavity has a higher energy density near the center of the vessel than a quasi-optical cavity, while quasi-optical cavities can leverage the quasi-optical properties of microwave energy to more closely control and direct the emission of energy into the cavity interior.

Turning back to microwave heating system 420 illustrated in FIG. 1, microwave distribution system 440 is operable to transmit or direct at least a portion of the microwave energy produced by microwave generator 422 into microwave heater 430, as discussed briefly above. As shown schematically in FIG. 1, microwave distribution system 440 can include at least one waveguide 442 operably coupled to one or more microwave launchers, illustrated as launchers 444*a-c*. Optionally, microwave distribution system 440 can comprise one or more microwave mode converters 446 for changing the mode of the microwave energy passing therethrough and/or one or more microwave switches (not shown) for selectively routing microwave energy to one or more of microwave launchers 444*a-c*. Additional details regarding specific components and various embodiments of microwave distributions system 440 will now be discussed in detail below.

Waveguides 442 can be operable to transport microwave energy from microwave generator 422 to one or more of microwave launchers 444*a-c*. As used herein, the term "waveguide" refers to any device or material capable of directing electromagnetic energy from one location to another. Examples of suitable waveguides can include, but are not limited to, co-axial cables, clad fibers, dielectric-filled waveguides, or any other type of transmission line. In one embodiment, waveguides 442 can comprise one or more dielectric-filled waveguide segments for transporting microwave energy from microwave generator 422 to one or more of launchers 444*a-c*.

Waveguides 442 can be designed and constructed to propagate microwave energy in a specific predominant mode. As used herein, the term "mode" refers to a generally fixed cross-sectional field pattern of microwave energy. In one embodiment of the present invention, waveguides 442 can be configured to propagate microwave energy in a $TE_{xy}$ mode, wherein x is an integer in the range of from 1 to 5 and y is 0. In another embodiment of the present invention, waveguides 442 can be configured to propagate microwave energy in a $TM_{ab}$ mode, wherein a is 0 and b is an integer in the range of from 1 to 5. It should be understood that, as used herein, the above-defined ranges of a, b, x, and y values as used to describe a mode of microwave propagation are applicable throughout this description. Further, in some embodiments, when two or more components of a system are described as being "$TM_{ab}$" or "$TE_{xy}$," components, the values for a, b, x, and/or y can be the same or different for each component. In one embodiment, the values for a, b, x, and/or y are same for each component of a given system.

The shape and dimensions of waveguides 442 can depend, at least in part, on the desired mode of the microwave energy to be passed therethrough. For example, in one embodiment, at least a portion of waveguides 442 can comprise $TE_{xy}$ waveguides having a generally rectangular cross-section, while, in another embodiment, at least a portion of waveguides 442 can comprise $TM_{ab}$ waveguides having generally circular cross-sections. According to one embodiment of the present invention, circular cross-section waveguides can have a diameter of at least about 8 inches, at least about 10 inches, at least about 12 inches, at least about 24 inches, at least about 36 inches, or at least about 40 inches. In another embodiment, rectangular cross-section waveguides can have a short dimension of at least about 1 inch, at least about 2 inches, at least about 3 inches and/or no more than about 6 inches, no more than about 5 inches, or no more than about 4 inches, while the long dimension can be at least about 6 inches, at least about 10 inches, at least about 12 inches, at least about 18 inches and/or no more than about 50 inches, no more than about 35 inches, or no more than about 24 inches.

As schematically illustrated in FIG. 1, microwave distribution system 440 can comprise one or more mode conversion segments 446 operable to change the mode of the microwave energy passing therethrough. For example, mode converter 446 can comprise a $TM_{ab}$-to-$TE_{xy}$ mode converter for changing the mode of at least a portion of the microwave energy from a $TM_{ab}$ to a $TE_{xy}$ mode. In another embodiment, mode conversion segment 446 can comprise a $TE_{xy}$-to-$TM_{ab}$ mode converter for receiving $TM_{ab}$ mode energy and converting and discharging microwave energy in a $TE_{xy}$ mode. The values for a, b, x, and y can be within the ranges described previously. Microwave distribution system 440 can comprise any number of mode converters 446 and, in one embodiment, can include at least 1, at least 2, at least 3, or at least 4 mode converters positioned at various locations within microwave distribution system 440.

Turning again to FIG. 1, microwave distribution system 440 can comprise one or more microwave launchers 444 for receiving microwave energy from generator 422 via waveguides 442 and emitting or discharging at least a portion of the microwave energy into the interior of microwave heater 430. As used herein, the terms "microwave launcher" or "launcher" refers to any device capable of emitting microwave energy into the interior of a microwave heater. The microwave distribution systems according to various embodiments of the present invention can employ at least 1, at least 2, at least 3, at least 4, at least 5, at least 6, at least 8, at least 10, and/or no more than 100, no more than 50, or no more than 25 microwave launchers. Microwave launchers can be any suitable shape and/or size and can be constructed of any materials, including, for example, selected carbon steels, stainless steels, nickel alloys, aluminum alloys, and copper alloys. In one embodiment wherein microwave distribution system 440 comprises two or more microwave launchers, each launcher can be made of the same material, while, in another embodiment, two or more launchers can be made of different materials.

In operation, microwave energy generated by one or more microwave generators 422 can be optionally routed or directed to one or mode converters 446 (if present) via waveguides 442. Thereafter, the microwave energy in waveguides 442 can be optionally split into two or more separate microwave portions (e.g., at least three portions as shown in FIG. 1) before being directed to one or more microwave launchers, illustrated as launchers 444*a-c* in FIG. 1. Microwave launchers 444*a-c* can be partially or entirely disposed within microwave heater 430 and can be operable to introduce or emit at least a portion of the microwave energy passed thereto into the interior of heater 430 via one or more spaced launch locations, thereby heating and/or drying the objects, articles, or load disposed therein. Specific configurations and details regarding various embodiments of microwave heating systems will now be discussed in detail below.

Turning now to FIGS. 4-6, several embodiments of microwave heating systems configured according to the present invention are provided. It should be understood that the microwave heating systems described below can be suitable for use in any of the processes and systems described previously, as well as any system or process wherein microwave heating is used. Further, it should be understood that, although described with reference to a particular figure or embodiment, all elements and components described below may be suitable for use in any microwave heating system configured according to one or more embodiments of the present invention.

Figure 4A:
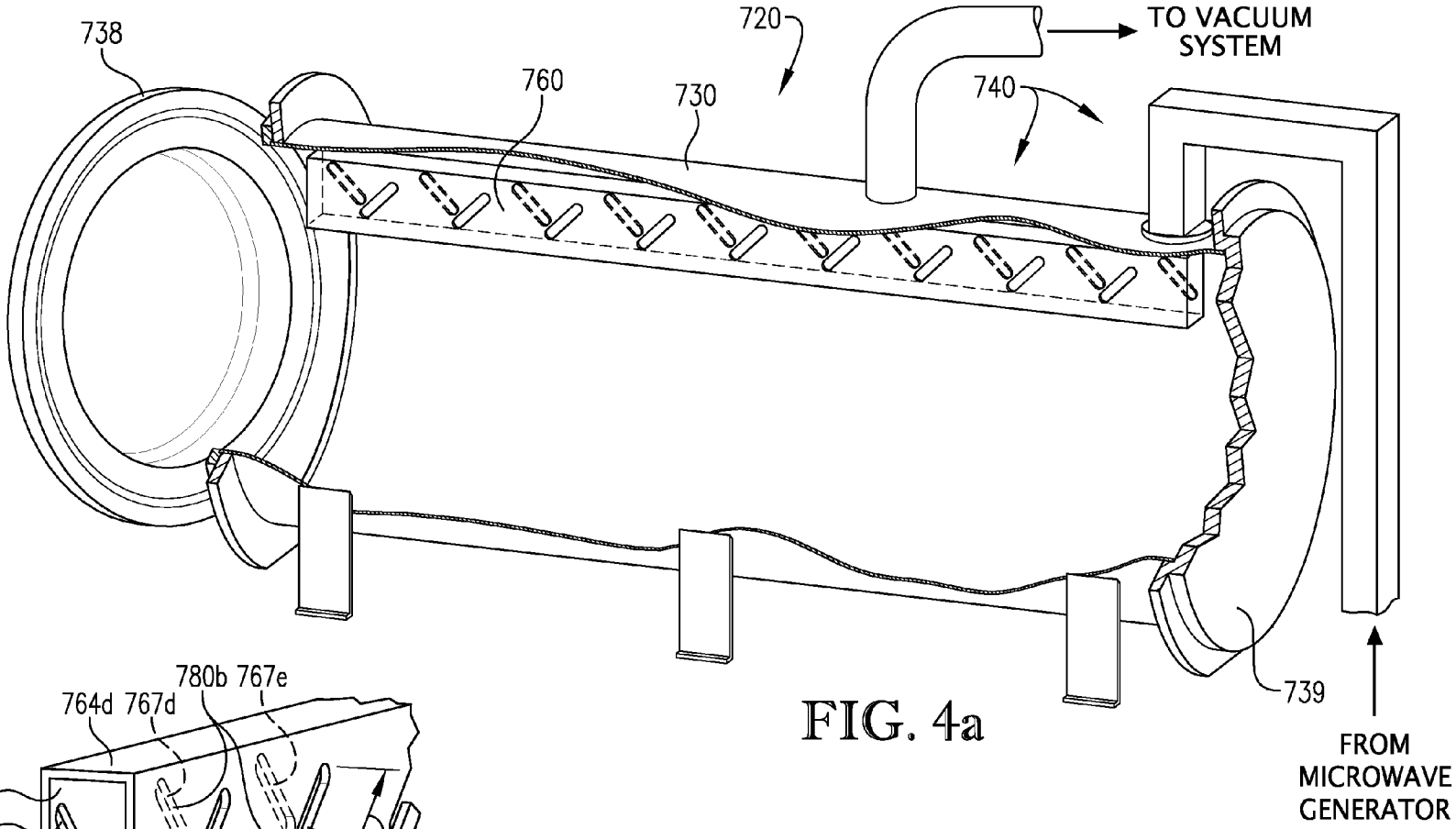
FIG. 4*a* is a cut-away isometric view of a microwave heater configured in accordance with one embodiment of the present invention, particularly illustrating the heater as being equipped with an elongated waveguide launcher having staggered launch openings on opposite sides of the launcher.
Figure 4B:
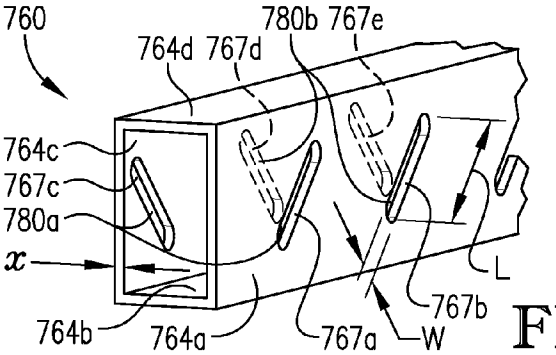
FIG. 4*b* is an enlarged partial view of the waveguide launcher depicted in FIG. 4*a*, particularly illustrating the configuration of the launch openings and the thickness of the sidewalls defining the launch openings.

Turning now to FIGS. 4*a* and 4*b*, one embodiment of a microwave heating system 720 is illustrated as comprising a microwave heater 730 and a microwave distribution system 740 for delivering microwave energy from a microwave generator (not shown) to heater 730. An optional vacuum system (not shown) can be operable in various embodiments to reduce the pressure in the interior of microwave heater 730 to, for example, no more than about 550 torr, no more than about 450 torr, no more than about 350 torr, no more than about 300 torr, no more than about 250 torr, no more than about 200 torr, no more than about 150 torr, no more than about 100 torr, no more than about 75 torr and/or no more than about 10 millitorr ($10^{-3}$ torr), no more than about 5 millitorr, no more than about 2 millitorr, no more than about 1 millitorr, no more than about 0.5 millitorr, or no more than about 0.1 millitorr. Several features of one or more embodiments of microwave heating system 720 will be discussed in detail below.

Turning now to FIG. 4*a*, microwave distribution system 740 is illustrated as comprising an elongated waveguide launcher 760 that is at least partially, and may be entirely, disposed within the interior of microwave heater 730. As shown in FIG. 4*a*, elongated waveguide launcher 760 can extend substantially horizontally within the interior of microwave heater 730. As used herein, the term "substantially horizontally" means within about 10° of horizontal. In one embodiment, the ratio of the length of elongated waveguide launcher 760 to the total length of the interior space of microwave heater 730 can be, for example, at least about 0.3:1, at least about 0.5:1, at least about 0.75:1, or at least about 0.90:1. In one embodiment, elongated waveguide launcher that extends substantially horizontally 760 can be located toward the upper or lower half of the interior volume of microwave heater 730 and may be at least partially or entirely vertically disposed above the heater entrance door 738 and an optional heater exit door (not shown) that, when present, is disposed on a generally opposite end of microwave heater 730. As used herein, the terms "upper" and "lower" volume refer to regions located in the upper vertical or lower vertical portion of the internal volume of the vessel. In one embodiment, elongated waveguide launcher 760 can be, for example entirely disposed within the uppermost one-third, one-fourth, or one-fifth of the interior volume of microwave heater 730, while, in another embodiment, elongated waveguide launcher 760 can be, for example disposed within the lowermost one-third, one-fourth, or one-fifth of the total interior volume of microwave heater 730. To measure the "uppermost" or "lowermost" fractional portions of the total interior volume described above, the portion of the vessel cross-section extending from the respective uppermost or lowermost wall of the vessel toward the central axis of elongation for the desired portion (e.g., one-third, one-fourth, or one-fifth) of the cross-section can be extended along the central axis of elongation to thereby define the "uppermost" or "lowermost" fractional volumes of the internal vessel space.

As shown in FIG. 4*a*, microwave heater 730, which can be configured to receive and heat one or more articles, comprises a heater entrance door 738, which can optionally comprise a choke (not shown). In one embodiment (not shown), microwave heater 730 can also comprise an optional heater exit door 739 positioned on the opposite end of microwave heater 730 from heater entrance door 738. When microwave heater 730 comprises a separate heater exit door 739, the article or objects to be heated can optionally be loaded via entrance door 738, passed through microwave heater 730 and unloaded via the exit door 739, rather than being both loaded and unloaded through heater entrance door 738. The reference to "entrance" and "exit" doors in this embodiment is not limiting, and the load or articles to be heated/dried can optionally be loaded via door 739, passed through microwave heater 730 and unloaded via door 738. Further, in another embodiment, the load can be both loaded (inserted) and unloaded (removed) from entrance door 738 when, for example, optional exit door 739 is not present. In one embodiment, elongated waveguide launcher 760 can be positioned in microwave heater 730 substantially below (not shown) or above the load such that, as the load is passed into, out of, and/or through the interior of heater 730, elongated launcher does not have to be moved, removed, retracted, or otherwise repositioned.

Referring now to FIG. 4*b*, a partial detailed isometric view of elongated waveguide launcher 760 is provided. In one embodiment, elongated waveguide launcher 760 can be substantially hollow and comprise one or more sidewalls. The one or more sidewalls can be configured in a variety of ways such that elongated waveguide launcher 760 can have a variety of cross-sectional shapes. For example, in one embodiment, elongated waveguide launcher 760 can have a single sidewall defining a substantially circular or elliptical cross-sectional shape. In another embodiment, as shown in FIG. 4*b*, elongated waveguide launcher 760 can comprise four substantially planar side walls 764*a-d* arranged to give launcher 760 a generally rectangular transverse (or, in another embodiment, square) cross-sectional configuration. Elongated waveguide launcher 760 can be configured to propagate and/or emit microwave energy in any suitable mode, including $TE_{xy}$ and/or $TM_{ab}$ modes, as discussed in detail previously. According to one embodiment, elongated waveguide launcher 760 can comprise a elongated $TE_{xy}$ launcher and, in one embodiment, can be implemented with commercially available rectangular waveguide sizes, such as WR284, WR430, or WR340. The specific dimensions of elongated waveguide launcher 760 can be any suitable dimensions and, in one embodiment, may be custom fabricated.

As illustrated in FIG. 4*b*, the one or more sidewalls of elongated waveguide launcher 760 can define a plurality of launch openings for discharging or emitting microwave energy into the interior of microwave heater 730. Although depicted in FIG. 4*b* as defining a plurality of elongated slots 767*a-e* having a generally rectangular shape with rounded ends, launch openings 767*a-e* can be of any suitable shape. Each of elongated slots 767*a-e* can define a length, designated as "L" in FIG. 4*b*, and a width, designated as "W" in FIG. 4*b*. In one embodiment, the length-to-width (L:W) ratio of elongated slots 767*a-e* can be, for example, at least about 2:1, at least about 3:1, at least about 4:1, or at least about 5:1. In addition, as shown in FIG. 4*b*, elongated slots 767*a-e* can be oriented at various angles with respect to the horizontal. In one embodiment, elongated slots 767*a-e* can extend at an angle relative to the horizontal of, for example, at least about 10°, at least about 20°, at least about 30° and/or, for example, no more than about 80°, no more than about 70°, or no more than about 60°. In one embodiment, each of elongated slots 767*a-e* can have equal shapes, sizes, and/or orientations. In one embodiment, the shapes, sizes, and/or orientations of individual elongated slots 767*a-e* can differ. Changes to the shape, size, and/or orientation of elongated slots 767*a-e* can impact the distribution of energy emitted from elongated waveguide launcher 760. Although shown as being uncovered in the embodiment illustrated in FIG. 4*b*, one or more launch openings 767 can be substantially covered by one or more covering structures (not shown) adjacent to the launch openings that are operable to prevent the flow of fluids into and out of openings 767, but that allow the discharge of microwave energy therefrom.

As shown in FIG. 4*b*, one or more of launch openings 767*a-e* can be at least partially, or entirely, defined by one or more sidewalls 764*a-d* of elongated waveguide launcher 760. In one embodiment, at least about 50 percent, at least about 75 percent, at least about 85 percent, or at least about 90 percent, for example, of the thickness of launch openings 767*a-e* can be defined by one or more sidewalls 764*a-d*. According to the embodiment illustrated in FIG. 4*b*, launch openings 767*a-e* can be at least partially, or entirely, defined by two substantially upright sidewalls 764*a,c*. As used herein, the term "substantially upright" means within 30° of vertical. Sidewalls 764*a-d* of elongated launcher 760 can be relatively thick in one embodiment, while, in other one embodiment, sidewalls 764*a-d* can be relatively thin. For example, the average thickness, designated as x in FIG. 4*b*, of sidewalls 764*a-d* can be at least about 1/32 (0.03125) inches, at least about 1/8 (0.125) inches, at least about 3/16 (0.1875) inches and/or, for example, no more than about 1/2 (0.5) inches, no more than about 1/4 (0.25) inches, no more than about 3/16 (0.1875) inches, or no more than about 1/8 (0.125) inches. According to one embodiment wherein one or more side walls of elongated waveguide launcher 760 are relatively thin, elongated waveguide launcher 760 can emit microwave energy into the interior of microwave heater 730 with a microwave launch efficiency of at least about 50 percent, at least about 75 percent, at least about 85 percent, at least about 90 percent, or at least about 95 percent. As used herein, the term "microwave launch efficiency" can be defined by converting the result of the following equation to a percentage: (total energy introduced into the launcher—total energy discharged from all of the openings of the launcher)÷(total energy introduced into the launcher).

Launch openings 767*a-e* can be arranged according to any suitable configuration or arrangement along elongated waveguide launcher 760. In one embodiment illustrated in FIG. 4*b*, launch openings 767*a-e* can include a first set of launch openings (e.g., launch openings 767*a,b*) disposed on one side of launcher 760 and a second set of launch openings (e.g., launch openings 767*c-e*) disposed on another, generally opposite side of elongated waveguide launcher 760. According to one embodiment, first and second sets of launch openings can be axially staggered from each other, such that corresponding openings (e.g., openings 767*a,c*, shown as launch pair or opening pair 780*a*, and openings 767*b,d*, shown as launch or opening pair 780*b*) are not axially aligned with one another. Although illustrated in FIG. 4*b* as having only two launch opening pairs 780*a,b*, it should be understood that any desired number of launch opening pairs can be utilized.

According to one embodiment, each launch pair 780*a,b* includes one launch opening disposed on one side of elongated waveguide launcher 760 (e.g., opening 767*a* of pair 780*a* and opening 767*b* of pair 780*b* both disposed on side wall 764*a*) and another launch opening disposed on the opposite side of launcher 760 (e.g., opening 767*c* of pair 780*a* and opening 767*d* of pair 780*b* both disposed on side wall 764*c* in FIG. 4*b*). In one embodiment, the openings 767*a,c* and 767*b,d* disposed on opposite sides of elongated waveguide launcher 760 can be axially aligned, while, in another embodiment, the oppositely-spaced openings 767*a,c* and 767*b,d* can form a plurality of "near neighbor" pairs (e.g., launch pairs 780*a,b* comprise "near neighbor" openings 767*a,c* and 767*b,d*, respectively). In one embodiment, for example, when an odd number of launch openings is used, one or more single launch openings may stand alone without forming a pair with any other opening. In one embodiment, the stand-alone opening may be an end opening, such as end opening 767*e* shown in FIG. 4*b*.

According to one embodiment wherein pairs 780*a,b* comprise near neighbor pairs of openings, at least one of the launch openings 767*a-d* of launch opening pairs 780*a,b* can be configured so as to cancel at least a portion of the microwave energy reflected back into the interior space of waveguide 760 as generated by one or more of the other launch openings 767*a-d* of the near-neighbor pairs 780*a,b*. For example, microwave energy reflections caused by opening 767*a* of pair 780*a* can be at least partially, substantially, or nearly entirely cancelled by the configuration of the other opening 767*b* of pair 780*a*. In a similar manner, the microwave energy reflections caused by opening 767*c* of pair 780*b* can be at least partially, substantially, or nearly entirely cancelled by the configuration of the other opening 767*d* of pair 780*b*.

Furthermore, in one embodiment when launch openings 767*a-d* are arranged in near neighbor pairs, the total amount of energy transferred from each of launch opening 767*a-d* of opening pairs 780*a,b* into the interior of microwave heater 730 can be equal to a fraction of the total amount of microwave energy introduced into launcher 760. For example, in one embodiment wherein the launcher comprises N paired launch openings and a single end opening, the fraction of microwave energy emitted from each pair of launch openings (and/or the unpaired or single end opening) can be expressed by the following formula: 1/(N+1). Thus, according to one embodiment illustrated in FIG. 4*b* wherein N=2, the total amount of energy emitted by each of pairs 780*a,b* can be equal to 1/(2+1) or 1/3 of the total energy introduced into elongated waveguide launcher 760. Similarly, in such embodiment the energy emitted from an unpaired launch opening (e.g., single end opening 767*e* in FIG. 4*b*) can be expressed by the formula 1/(N+1). Thus, in the embodiment shown in FIG. 4*b*, launch opening 767*e* can also emit approximately 1/3 of the total energy introduced into elongated waveguide launcher 760.

Figure 5A:
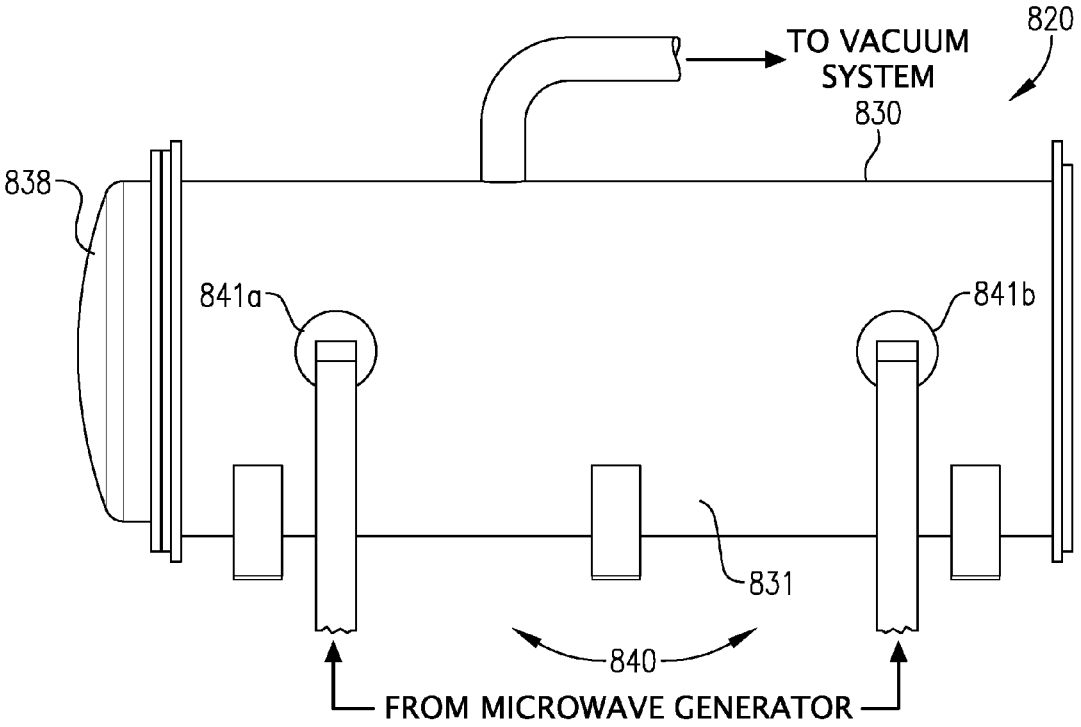
FIG. 5*a* is a side view of a microwave heating system configured in accordance with one embodiment of the present invention, particularly illustrating a microwave distribution system for delivering microwave energy to the microwave heater.

Another embodiment of a microwave heating system 820 is provided in FIGS. 5*a-h*. As shown in FIG. 5*a*, microwave heating system 820 comprises a microwave heater 820 and a microwave distribution system 840 operable to transport microwave energy from a microwave generator (not shown) to heater 820. In one embodiment, microwave heating system 820 can also comprise a vacuum system (not shown) for reducing the pressure in microwave heater 830 below atmospheric pressure. As shown in FIG. 5*a*, microwave heater 830 can include a heater entrance door 838 for introducing one or more articles (a load) into the interior of heater 830. Optionally, microwave heater 830 can comprise a heater exit door (not shown in FIG. 5*a*) disposed on the generally opposite end of heater 830 from heater entrance door 838. In addition, microwave heater 830 can comprise a plurality of spaced launch openings, such as those illustrated as 841*a,b* in FIG. 5*a*, located at various positions along one or more external side walls 831 of microwave heater 830. Launch openings 841*a,b* can be operable to accommodate one or more components of microwave distribution system 840, thereby facilitating the transmission of microwave energy into microwave heater 830. Additional details regarding microwave distribution system 840 will now be discussed in further detail with regard to FIGS. 5*b-h*.

Figure 5B:
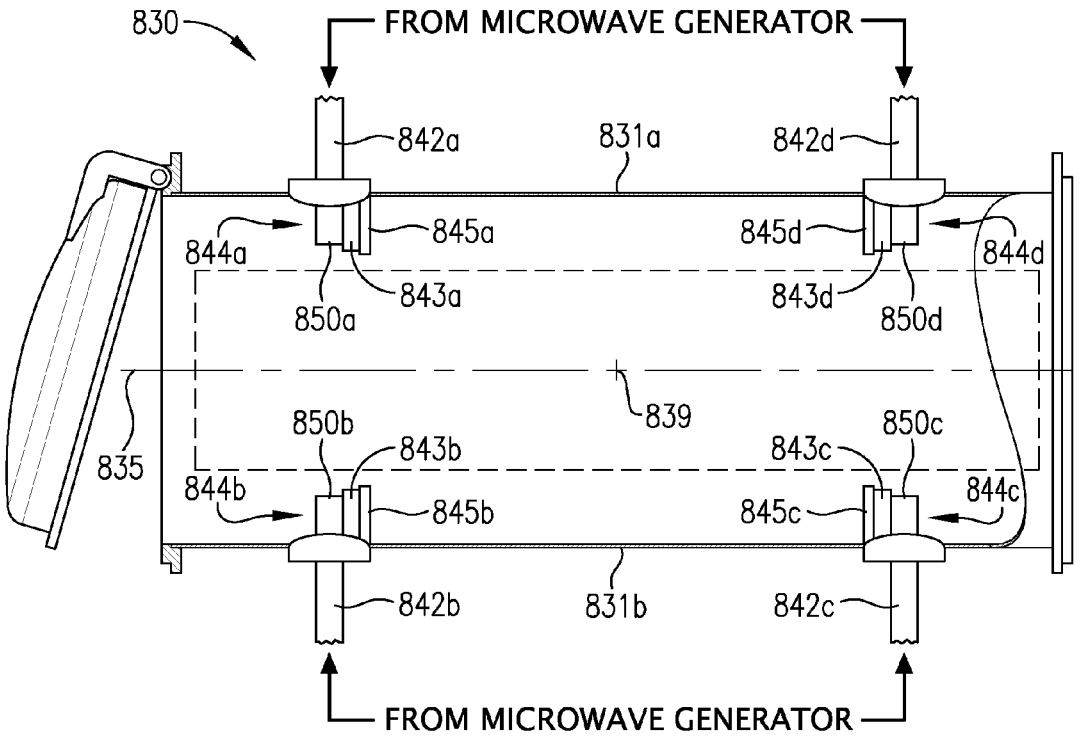
FIG. 5*b* is a top cut-away view of the microwave heater depicted in FIG. 5*a*, particularly illustrating the microwave distribution system as including one pair of $TM_{ab}$ launchers on one side of the microwave heater and a second pair of the $TM_{ab}$ launchers on the opposite side of the microwave heater.

Turning FIG. 5*b*, a top partial cutaway view of microwave heater 830 is provided, particularly illustrating a plurality of microwave launchers 844*a-d* directly or indirectly coupled to opposite sidewalls 831*a,b* of microwave heater 830. As used herein, the term "indirectly coupled" refers to one or more intermediate pieces of equipment used to at least partially connect one or more launchers to the vessel. Launchers 844*a-d* can be operable to emit microwave energy into the interior of microwave heater 830 via one or more open outlets 845*a-d*, as shown in FIG. 9*b*. Although illustrated in FIG. 5*b* as comprising four launchers 844*a-d*, it should be understood that microwave heater 830 can comprise any desired number of launchers. In one embodiment (not shown), microwave heater 830 can comprise two additional launchers axially positioned to the left of launchers 844*a,b* in FIG. 5*b* and/or to the right of launchers 844*c,d*. The additional launchers (not shown) can be facing in the same direction and/or in different directions. For example, in one embodiment shown in FIG. 5*b*, launchers 844*a-d* are shown as facing in opposite directions. Further, in one embodiment (not shown), microwave heater 830 can comprise four additional launchers, arranged in an analogous manner as launchers 844*a-d*, illustrated in FIG. 5*b*, as described further below.

Microwave launchers 844 can be positioned along, within, or proximate microwave heater 830 according to any suitable configuration. In one embodiment, microwave launchers 844 can be configured to comprise two pairs of launchers. The individual launchers within the pair can be located on generally the same side (e.g., the pair comprising launchers 844*a* and 844*d* and the other pair comprising launcher 844*b* and 844*c*) or on generally opposite sides (e.g., the pair comprising microwave launchers 844*a* and 844*b* and the other pair comprising 844*c* and 844*d*) of microwave heater 830.

As used herein, the term "generally opposite sides" or "opposite sides" refers to two launchers positioned such that the angle of radial alignment defined therebetween is in the range of from at least about 90° to about 180°. The "angle of radial alignment (β)" is defined as the angle formed between two straight lines drawn from the center of each launcher to the central axis of elongation of the vessel. For example, FIG. 5*c* shows exemplary launchers 845 and 846*a*, defining an angle of radial alignment, $\beta_1$, therebetween. The angle of radial alignment between two launchers positioned on generally opposite sides of a vessel can be at least about 120°, at least about 150°, at least about 165° and/or no more than about 180° or approximately 180°. In one embodiment, two launchers can be positioned on generally opposite sidewalls, as generally depicted in FIG. 5*b*, while, in another embodiment, two oppositely disposed launchers can be positioned at or near the vertical top and bottom of the heater (not shown).

In one embodiment wherein one or more pairs launchers include individual launchers located on generally opposite sides of a microwave heater (e.g., launchers 844*b* and 844*a* or launchers 844*c* and 844*d* in FIG. 5*b*), the individual launchers within the pairs can also be axially aligned with one another. As used herein, the term "axially aligned" refers to two launchers defining an angle of axial alignment therebetween in the range of from 0° to 45°. As used herein, the "angle of axial alignment" can be defined by the angle formed between the shortest straight lines drawn between the centers of each launcher (that also intersects the axis of elongation of the vessel) and a line drawn perpendicular to the axis of elongation. In FIG. 5*d*, the angle of axial alignment, α, is formed between line 850, which is drawn between the centers of exemplary launchers 845 and 846, and line 852, which is perpendicular to the axis of elongation 835*a*. In one embodiment, axially aligned launchers can define an angle of axial alignment of at least about 0° and/or, for example, no more than about 30° or no more than about 15°.

In another embodiment, individual launchers within a pair can be located on generally the same side of a microwave heater. As used herein, the term "generally the same side" or "same side" refers to two launchers having an angle of radial alignment, β, in the range of from at least or equal to 0° to about 90°. Exemplary launchers 845 and 846*b* in FIG. 5*c* are located on generally the same side of the microwave heater, as the angle of radial alignment defined therebetween (e.g., $\beta_2$) is no more than about 90°. In one embodiment, two launchers disposed on the same side of a microwave heater can define an angle of radial alignment of at least about 0° and/or no more than about 60°, no more than about 30°, and no more than about 15°, or approximately 0°.

In one embodiment wherein one or more pairs of launchers include individual launchers located on generally the same side of a microwave heater (e.g., launchers 844*a* and 844*d* or launchers 844*b* and 844*c* in FIG. 5*b*), the individual launchers within the pairs can also be axially adjacent to one another. As used herein, the term "axially adjacent" refers to two or more launchers positioned on the same side of a microwave heater such that no other launchers on that side are disposed between the axially adjacent launchers. According to one embodiment wherein a microwave distribution system comprises two or more pairs of oppositely positioned microwave launchers, one launcher from the first pair is disposed on generally the same side as one launcher from the second pair, thereby creating an axially adjacent pair of launchers.

As illustrated in FIG. 5*b*, each of microwave launchers 844*a-d* can define a respective open outlet 845*a-d* for emitting microwave energy into the interior of microwave heater 830. Open outlets can be positioned to emit energy into the interior of microwave heater 830 in any suitable pattern or direction. For example, in one embodiment shown in FIG. 5*b*, open outlets of axially adjacent launchers (e.g., outlets 845*a,d* of launchers 844*a,d* and outlets 845*b,c* of launchers 844*b,c*) can be oriented to face each other in a direction substantially parallel to the external sidewall to which the launchers are coupled (e.g., sidewall 831*a* for launchers 844*a,d* and sidewall 831*b* for launchers 844*b,c*), thereby discharging microwave energy in that general direction. As used herein, the term "substantially parallel" means within about 10° of parallel. In one embodiment, at least one of open outlets 845*a-d* can be oriented to discharge energy substantially parallel to the axis of elongation of microwave heater 830, designated as line 835 in FIG. 5*b*. According to one embodiment, at least one of open outlets 845*a-d* can be oriented toward an axial midpoint of heater 830. As used herein, the "axial midpoint" of a vessel is defined by a plane that is orthogonal to axis of elongation 835 and intersects the midpoint 839 of the axis of elongation 835 as shown in FIG. 5*b*. In one embodiment, each of open outlets 845*a-d* are oriented toward the axial mid-point of heater 830 such that the open outlet 845*a,b* of front-side launchers 844*a,b* substantially face towards open outlets 845*c,d* of back-side launchers 844*c,d*, as depicted in FIG. 5*b*.

According to one embodiment, in operation, microwave energy produced by one or more microwave generators (not shown) can be transported via waveguides 842*a-d* to launchers 844*a-d*, which emit the energy into the interior of microwave heater 830. Although not illustrated in FIG. 5*b*, any number or configuration of microwave generators can be used to produce microwave energy for use in microwave heating system 820. In one embodiment, a single generator can be used to supply energy to heater 830 via waveguides 842*a-d* and launchers 844, while, in another embodiment, heating system 820 can include two or more generators. According to another embodiment, a network of one or more microwave generators can be utilized such that microwave energy is emitted from at least one, at least two, at least three, or all four of microwave launchers 844*a-d* at substantially the same time. In one embodiment, one or more launchers 844*a-d* can be coupled to a single generator and the energy from the generator can be allocated amongst the launchers using one or more microwave switches. In another embodiment, one or more of launchers 844*a-d* can have a singly-dedicated generator, such that at least about 75 percent, at least about 90 percent, or substantially all of the microwave energy produced by that generator is routed to a single launcher. Additional details regarding specific embodiments of microwave generators, waveguides, and launchers and the operation thereof are provided shortly, with respect to FIGS. 7*a* and 7*b*.

The microwave energy propagated by waveguide segments 842*a-d* can be in any suitable mode, including, for example, a $TM_{ab}$ mode and/or a $TE_{xy}$ mode, wherein a, b, x, and y have values as previously defined. In one embodiment, waveguide segments 842*a-d* each comprise $TE_{xy}$ waveguide segments, with segments 842*a* and 842*d* configured to penetrate sidewall 831*a* and segments 842*b* and 842*c* configured to penetrate sidewall 831*b* and extend radially into the interior of microwave heater 830, toward the axis of elongation 835, as shown in FIG. 5*b*.

According to one embodiment of the present invention, the mode of the microwave energy propagated through waveguide segments 842*a-d* can be changed prior to (or simultaneously with) being emitted into the interior of microwave heater 830. For example, in one embodiment, $TE_{xy}$ mode energy produced by the microwave generator (not shown in FIG. 5*b*) can be emitted into microwave energy as $TM_{ab}$ mode energy after passing through one or more mode converting segments, represented in FIG. 5*b* as mode converters 850*a-d*. Mode converters can be of any suitable size and shape and any suitable number of mode converters can be used in microwave distribution system 840. In one embodiment, one or more mode converters 850*a-d* can be disposed outside of the interior space (volume) of microwave heater 830, while, in another embodiment, mode converters 850*a-d* can be partially, or entirely, disposed within the interior of microwave heater 830. Mode converters 850*a-d* can be located in or near sidewalls 831*a,b* or, as illustrated in FIG. 5*b*, can be spaced from external sidewalls 831*a,b* of microwave heater 830.

According to one embodiment wherein mode converters 850*a-d* are partially or entirely disposed within heater 830, the microwave energy can initially enter the microwave heater in a $TE_{xy}$ mode and, subsequently, at least a portion of the energy can be converted such that at least a portion of the energy emitted from launchers 844*a-d* into the interior of microwave heater 830 can be in a $TM_{ab}$ mode. In one embodiment, waveguide segments 842*a-d* can comprise $TE_{xy}$ waveguide segments operable to transmit microwave energy from the generator to heater 830 in a $TE_{xy}$ mode. In one embodiment, at least a portion of $TE_{xy}$ waveguide segments 842*a-d* can be integrated into launchers 844*a-d* as depicted shown in FIG. 5*b*. As the energy passes from waveguide segments 842*a-d* through mode converters 850*a-d*, the energy is converted to a $TM_{ab}$ mode. Subsequently, the $TM_{ab}$ mode energy exiting mode converters 850*a-d* can then pass through a respective $TM_{ab}$ waveguide segment 843*a-d*, illustrated in FIG. 5*b* as being entirely disposed within the interior of microwave heater 830 and spaced from the sidewalls 833 thereof, before being discharged into heater 830 via $TM_{ab}$ open outlets 845*a-d*.

Figure 5E:
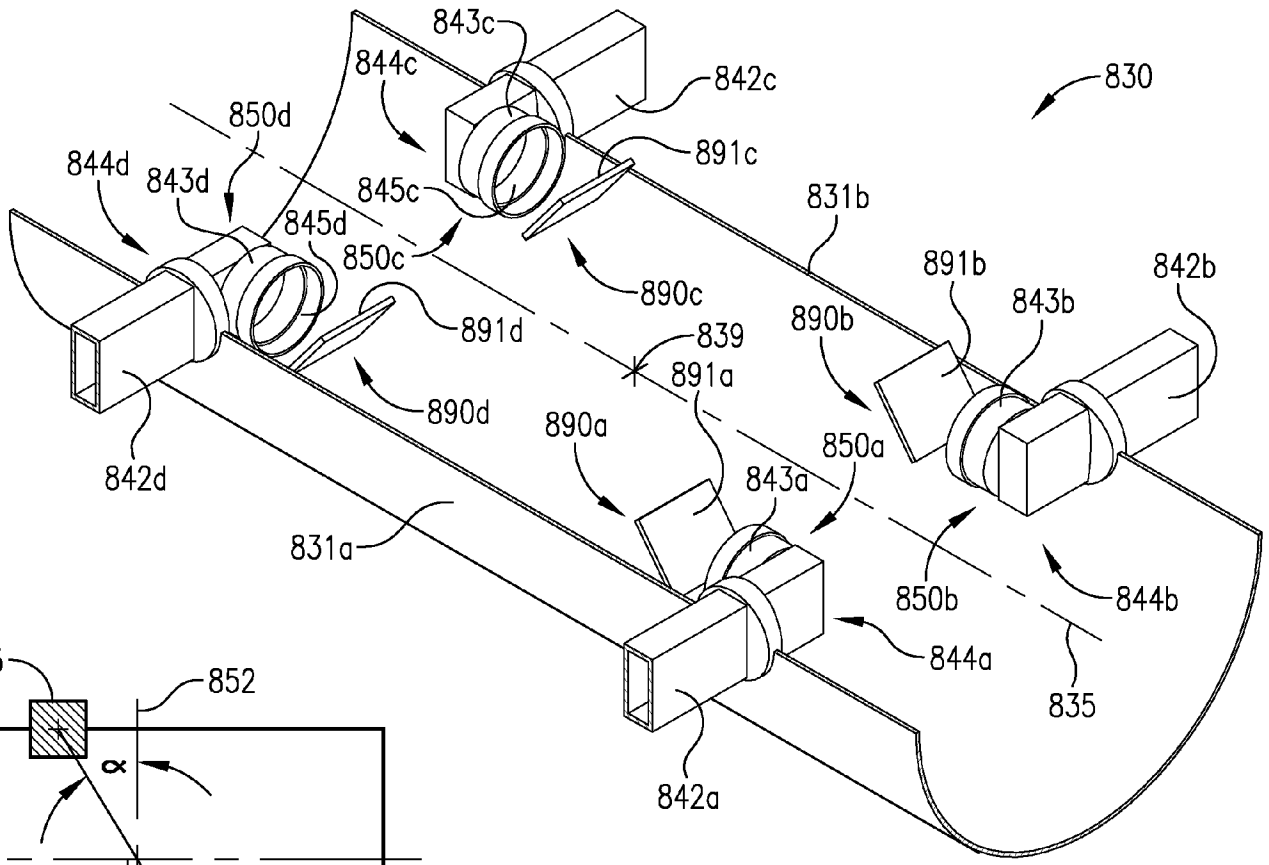
FIG. 5*e* is a partial cut-away isometric view of a microwave launching and reflecting or dispersing system configured in accordance with one embodiment of the present invention, particularly illustrating a launch system similar to that depicted in FIG. 5*b* but also including a movable reflector associated with each microwave launcher.
Figure 5C:
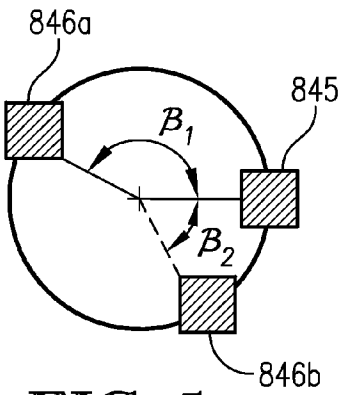
FIG. 5*c* is a diagram illustrating what is meant by the terms "opposite side" and "same side"
Figure 5D:
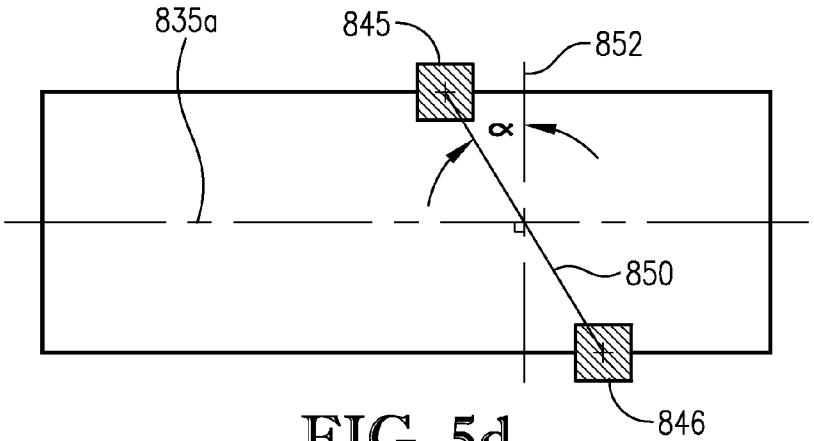
FIG. 5*d* is a diagram illustrating what is meant by the term "axially aligned"

According to another embodiment depicted in FIG. 5*e*, microwave heating system 820 can comprise one or more reflectors 890*a-d* positioned near the open outlets 845*a-d* and operable to reflect or disperse microwave energy emitted from launchers 844*a-d* into microwave heater 830. In one embodiment, the reflectors can be fixed or stationary reflectors, such that energy is reflected or dispersed while the position of the reflector does not change. In another embodiment illustrated in FIG. 5*e*, one or more of reflectors 890 can be a movable reflector operable to change position in order to reflect or disperse microwave energy into microwave heater 830. Each movable reflector 890*a-d* in FIG. 5*e* presents a respective reflecting surface 891*a-d* for reflecting or dispersing energy emitted from microwave launchers 844*a-d*. As shown in FIG. 5*e*, each reflecting surface can be spaced from external side walls 831*a,b* and can be positioned such that one or more of the respective launch openings 845*a-d* of launchers 844*a-d* face toward their respective reflective surfaces 891*a-d* which, in turn, are positioned to contact, direct, or reflect at least a portion of the microwave energy from launch openings 845*a-d*. In one embodiment, at least a portion of, or substantially all of, the microwave energy emitted from microwave launchers 844*a-d* can at least partially contact and can be least partially reflected or dispersed by respective reflector surfaces 891*a-d*. In one embodiment, one or more of reflecting surfaces 891*a-d* can be oriented to face a direction that is substantially parallel the direction of elongation of external side walls 831*a,b*.

In one embodiment, reflector surfaces 891*a-d* can be substantially planar, while, in other embodiment, one or more reflector surfaces 891*a-d* can be non-planar. For example, in one embodiment, one or more non-planar reflector surfaces 891*a-d* can define a curvature as illustrated by embodiment depicted in FIG. 5*h*. Reflector surfaces 891*a-d* can be smooth or can one or more convexities. As used herein, the term "convexity" refers to a region of a reflector that is surface operable to disperse, rather than reflect, energy therefrom. In one embodiment, a convexity can have a generally convex shape, as illustrated by the examples of convexities 893*a,b* shown in FIGS. 5*f* and 5*g*. In another embodiment, a convexity can have a generally concave shape, such as, for example, a dimple or other similar indentation.

According to one embodiment of the present invention, one or more reflectors 890*a-d* can be movable reflectors. Movable reflectors can be any reflectors operable to change position. In one embodiment, movable reflectors 890*a-b* can be oscillating reflectors capable of moving in a designated pattern, such as, for example, a generally up-and-down pattern or a pattern of rotation about an axis. In one embodiment, movable reflectors can be randomly movable reflectors operable to move in any of a variety of random and/or unplanned movements.

Figure 5I:
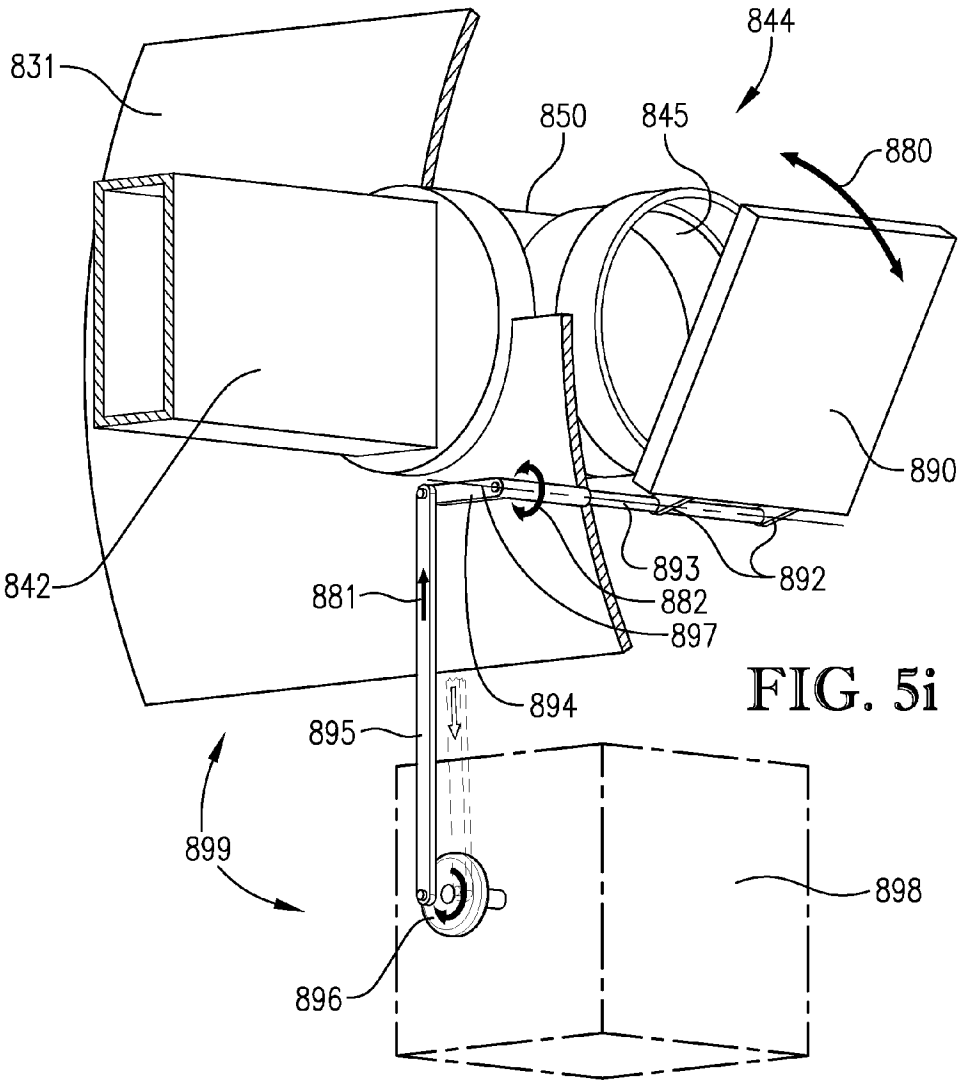
FIG. 5*i* is an enlarged, cut-away, isometric view of a microwave launcher and reflector pair previously depicted in FIG. 5*e*, particularly illustrating an actuator system for providing oscillating movement of the reflector.
Figure 5F:
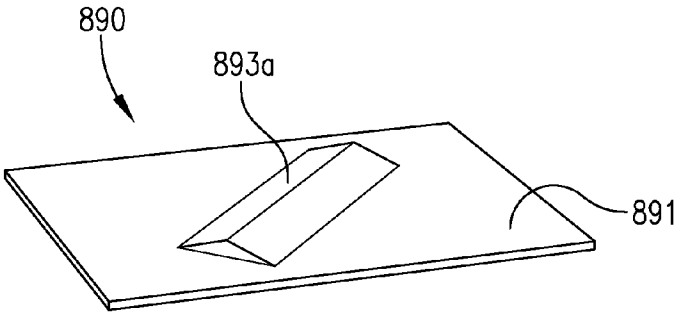
FIG. 5*f* is an isometric view of one embodiment of a reflector suitable for use in a microwave heating system as described herein, particularly illustrating the reflector as having a non-planar reflecting surface with a concavity of a first configuration.
Figure 5G:
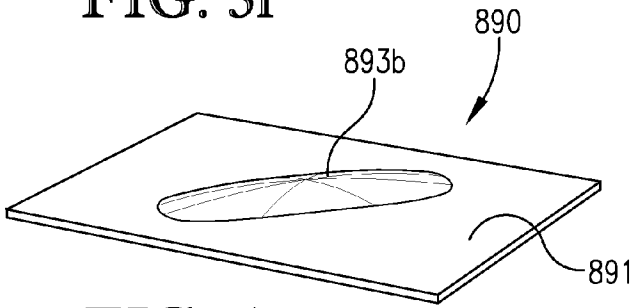
FIG. 5*g* is an isometric view of another embodiment of a reflector suitable for use in a microwave heating system described herein, particularly illustrating the reflector as having a non-planar reflecting surface with a concavity of a second configuration.
Figure 5H:
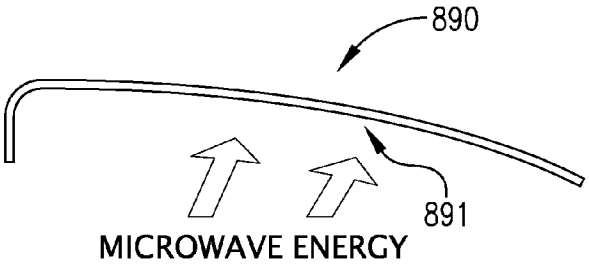
FIG. 5*h* is a side elevation view of one embodiment of a reflector suitable for use in a microwave heating system described herein, particularly illustrating the curvature of the reflector surface.

Movable reflectors 890*a-d* can be movably coupled to microwave heater 830 according to any suitable method. For example, in one embodiment illustrated in FIG. 5*i*, microwave heater 830 can comprise a reflector driver system (or actuator) 899 for movable reflector 890 within the interior space of heater 830. As shown in FIG. 5*i*, reflector driver system 899 can comprise one or more support arms 892, which fastenably couple reflector 890 to an oscillating shaft 893. In order to cause shaft 893 to rotate and thereby move reflector 890 in an in-an-out pattern, as generally indicated by arrow 880, a motor 898 can turn a wheel 896 to which a linear shaft 895 can be coupled in a generally off-center manner. As indicated by arrow 881, shaft 895 can move in a generally up-and-down manner as wheel 896 turns, thereby causing a lever arm 894 to rotate shaft 893 about pivot axis 897, as generally indicated by arrow 882. As a result, reflector 890 can move as generally indicated by arrow 880 and can be operable to reflect or to disperse at least a portion of the microwave energy emitted from discharge opening 845 of microwave reflector 844 in a pattern determined, at least in part, by the movement of reflector 890.

Yet another embodiment of a microwave heating system 920 is shown in FIGS. 6*a-f*. As illustrated in one embodiment FIG. 6*a*, a microwave heater 930 comprises a heater entrance door 938 for loading a load into the interior of heater 930 and a heater exit door 939 for removing the load from microwave heater 930. Although illustrated in FIG. 6*a* as including separate entrance and exit doors 938, 939, it should be understood that microwave heater 930 can, in another embodiment, include only a single door for both loading and unloading the load from the interior of microwave heater 930. In the embodiment shown in FIG. 6*a*, heater entrance and exit doors 938, 939 can be located on generally opposite ends of microwave heater 930 such that the load can be generally passed through heater 930 via a transport mechanism, such as, for example, a cart (not shown). In addition, microwave heating system 920 can comprise an optional vacuum system (not shown) for controlling the pressure in heater 930.

Figure 6A:
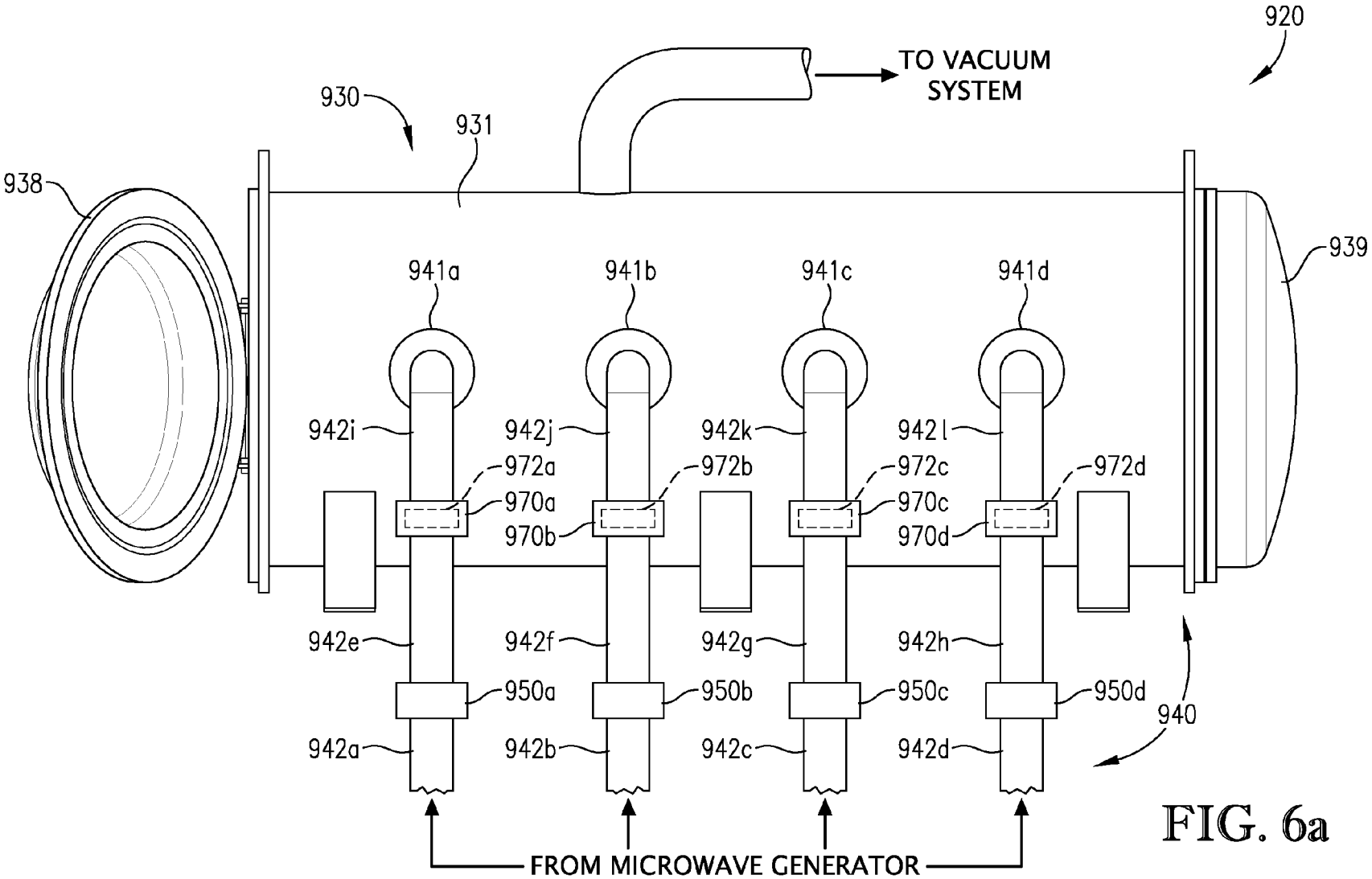
FIG. 6*a* is a side view of a microwave heating system configured in accordance with one embodiment of the present invention, particularly illustrating a microwave distribution system equipped with a plurality of $TM_{ab}$ barrier assemblies.

As shown in FIG. 6*a*, microwave heating system 920 can include a microwave distribution system 940 comprising a plurality of spaced launch openings 941*a-d* defined in an external sidewall 931 of microwave heater 930. Each launch opening 941 can be operable to receive a microwave launcher (not shown) for emitting energy into the interior of microwave heater 930. Microwave launchers can be at least partly, or entirely, disposed within the interior of microwave heater 930. Specific embodiments of one or more types of microwave launchers will be discussed in more detail shortly.

According to one embodiment, microwave energy produced by a microwave generator (not shown) can be transmitted in a $TE_{xy}$ mode through waveguide segments 942*a-d* prior to passing through external $TE_{xy}$-to-$TM_{ab}$ mode converters 950*a-d*, which convert the energy passing therethrough to a $TM_{ab}$ mode. The resulting $TM_{ab}$ mode microwave energy can then exit mode converters 950*a-d* via respective waveguide segments 942*e-h*, as illustrated in FIG. 6*a*. Thereafter, at least a portion of the microwave energy in $TM_{ab}$ waveguide segments 942*e-h* can be passed through respective barrier assemblies 970*a-d* prior to entering microwave heater 930 via $TM_{ab}$ waveguide segments 942*i-l*. As used herein, the term "barrier assembly" can refer to any device operable to fluidly isolating the microwave heater from an external environment, while still permitting the passage of microwave energy therethough. For example, in one embodiment shown in FIG. 6*a*, respective barrier assemblies 970*a-d* can each comprise at least one sealed window member 972*a-d*, which can be permeable to microwave energy, but provides a desired degree fluid isolation between each upstream 942*e-h* $TM_{ab}$ waveguide segment and each of downstream 942*i-l* $TM_{ab}$ waveguide segments. As used herein, the term "sealed window member" refers to a window member configured in a manner that it will provide sufficient fluid isolation between the two spaces on either side of the window member to allow maintaining a pressure differential across such window member. Additional details regarding specific embodiments of barrier assemblies 970*a-d* will now be discussed in detail, with respect to FIG. 6*b*.

Barrier assemblies configured according to one embodiment of the present invention minimize or eliminate arcing, even at high energy throughputs and/or low operating pressures. According to one embodiment of the present invention, each barrier assembly 970*a-d* can permit energy passage at a rate of at least about 5 kW, at least about 30 kW, at least about 50 kW, at least about 60 kW, at least about 65 kW, at least about 75 kW, at least about 100 kW, at least about 150 kW, at least about 200 kW, at least about 250 kW, at least about 350 kW, at least about 400 kW, at least about 500 kW, at least about 600 kW, at least about 750 kW, or at least about 1,000 kW and/or not more than about 2,500 kW, not more than about 1,500 kW, or not more than about 1,000 kW through its respective window member 972*a-d*, while the pressure in microwave heater 930 can be no more than about 550 torr, no more than about 450 torr, no more than about 350 torr, no more than about 250 torr, no more than about 200 torr, no more than about 150 torr, no more than about 100 torr, or no more than about 75 torr. In one embodiment, the pressure in microwave heater can be no more than about 10 millitorr, no more than about 5 millitorr, no more than about 2 millitorr, no more than about 1 millitorr, no more than about 0.5 millitorr, or no more than about 0.1 millitorr. In one embodiment, the microwave energy passed through barrier assemblies 970*a-d* can be introduced such that the electromagnetic field is maintained lower than the threshold of arcing to thereby prevent or minimize arcing in barrier assemblies 970*a-d*.

Figure 6B:
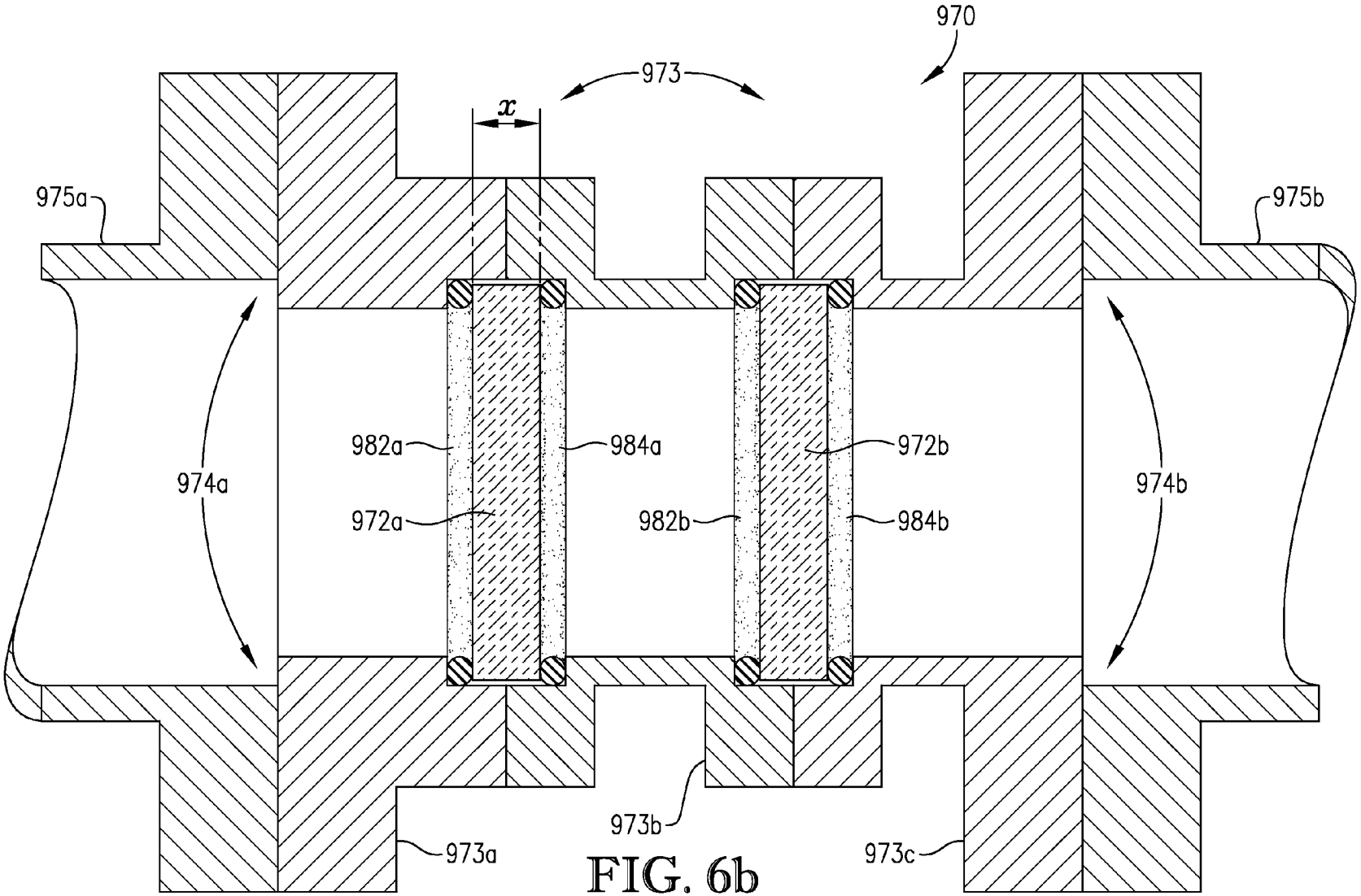
FIG. 6*b* is an axial sectional view of one of the $TM_{ab}$ barrier assemblies depicted in FIG. 6*a*, particularly illustrating the barrier assembly as having two floating, sealed windows and impedance transforming diameter step-changes near the junction of the barrier assembly and the waveguides between which the barrier assembly is coupled.

Turning now to FIG. 6*b*, an axial cross-sectional view of a barrier assembly 970 is provided. Barrier assembly 970 comprises a first sealed window member 972*a* and an optional second sealed window member 972*b* disposed within a barrier housing 973. When present, second sealed window member 972*b* can be operable to cooperate with first sealed window member 972*a* to provide a desired level of fluid isolation between the upstream (e.g., entry) and downstream (e.g., exit) $TM_{ab}$ waveguide segments 975*a,b* while permitting the passage of at least a portion of the microwave energy from first $TM_{ab}$ waveguide segment 975*a* to second $TM_{ab}$ waveguide segment 975*b*. According to one embodiment, first and second $TM_{ab}$ waveguide segments 975*a,b* can have circularly cylindrical cross-sections. In one embodiment, waveguide segments 975*a,b* can be two ends of a single continuous waveguide, in which barrier assembly 970 can be disposed, while, in another embodiment, waveguide segments can be two separate waveguide portions or components suitably fastened or coupled to either side of barrier assembly 970.

As shown in FIG. 6*b*, barrier housing 973 can comprise a first or entry section 973*a*, an optional second or intermediate section 973*b*, and third or exit section 973*c*, with first sealed window member 972*a* disposed between first and second sections 973*a,b* and second sealed window member 972*b* disposed between second and third sections 973*b,c*. According to one embodiment, the pressure of each of first, second, and third segments 973*a,b,c* can be different. For example, in one embodiment, the pressure of first segment 973*a* can be greater than the pressure of second segment 973*b*, which can be greater than the pressure of third segment 973*c*. Each of first, second, and third sections 973*a-c* of barrier housing 973 can be held together by any suitable fastening device (not shown), such as, for example screws, bolts, and the like. Further, barrier assemblies 970*a-d* can also comprise one or more impedance transformers, which alter the impedance of the microwave radiation. An example is illustrated as impedance transforming diameter step changes 974*a,b* in the embodiment shown in FIG. 6*b*, for maximizing energy transfer from the microwave generator (not shown) to the load in the microwave heater (not shown). In one embodiment, impedance transforming diameter step changes 974*a,b* can be located near at least one of sealed window members 972,*b*, while, in another embodiment, step changes 974*a,b* can be located near or at least partially defined by the entry and/or exit $TM_{ab}$ waveguides 975*a,b*.

Figure 7A:
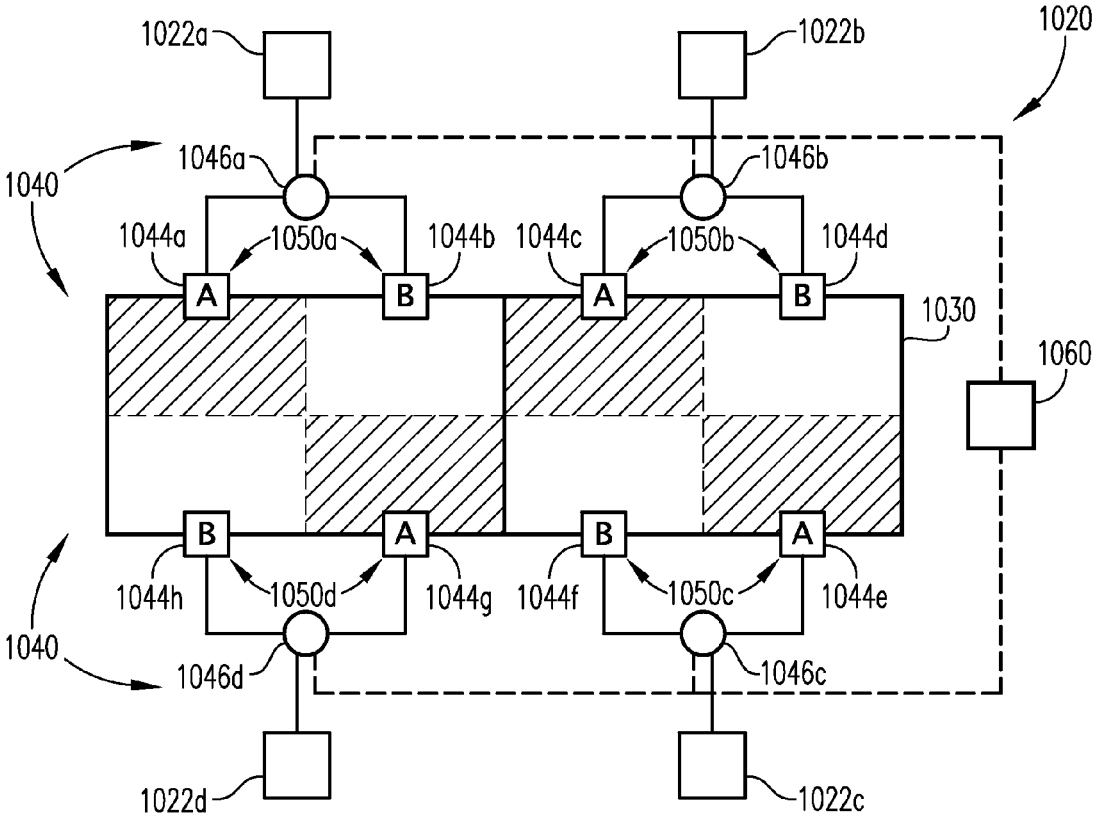
FIG. 7*a* is a schematic top view of a microwave heating system configured in accordance with one embodiment of the present invention, particularly illustrating the heating system as including a plurality of microwave switches for routing microwave energy to different microwave launchers in an alternating fashion.
Figure 7B:
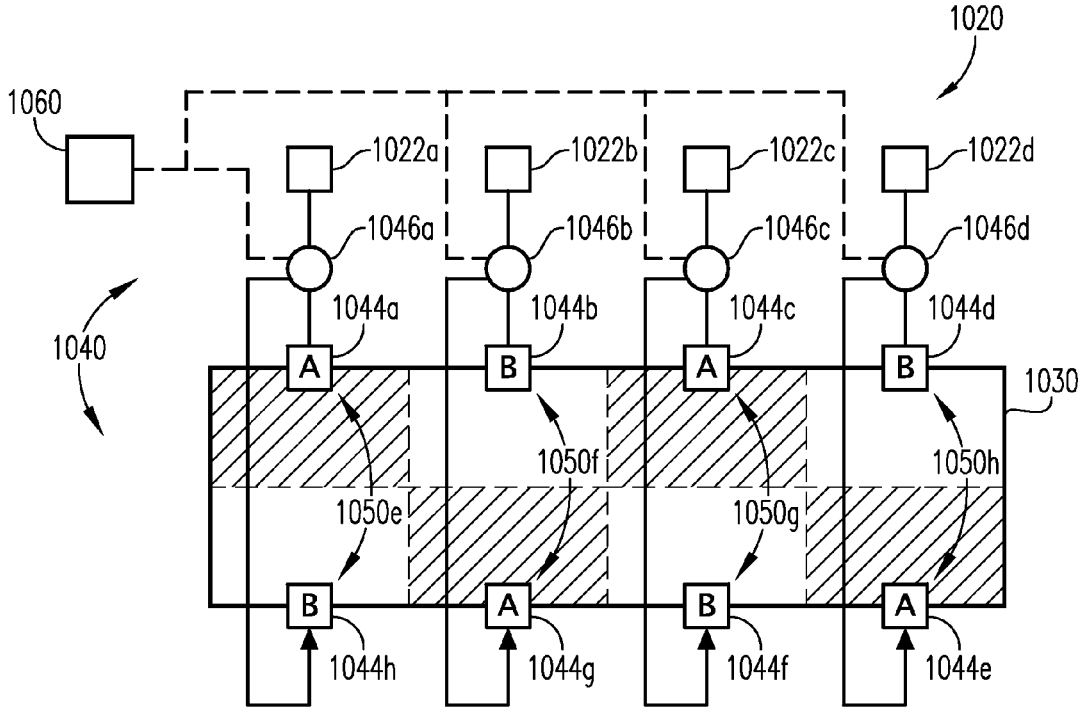
FIG. 7*b* is a schematic view of a microwave heating system configured in accordance with an alternative embodiment of the present invention, particularly illustrating the heating system as including a plurality of microwave switches for routing microwave energy to different microwave launchers in an alternating fashion.

As illustrated in FIGS. 7*a* and 7*b*, sealed window members 972*a,b* can comprise one or more discs. Each disc can be constructed of any material with a suitable degree of corrosion resistance, strength, impermeability to fluids, and permeability to microwave energy. Examples of suitable materials can include, but are not limited to, aluminum oxide, magnesium oxide, silicon dioxide, beryllium oxide, boron nitride, mullite, and/or polymeric compounds such as TEFLON. According to one embodiment, the loss tangent of the disc can be no more than about $2\times10^{-4}$, no more than about $1\times10^{-4}$, no more than about $7.5\times10^{-5}$, or no more than about $5\times10^{-5}$.

The discs can have any suitable cross-section. In one embodiments discs can have a cross-section compatible with the cross-section of the adjoining waveguides 975*a,b*. In one embodiment, the discs can have a substantially circular cross-section and can have a thickness, designated in FIG. 6*b* as "x", equal to at least about ⅛, at least about ¼, at least about ½ and/or no more than about 1, no more than about ¾, or no more than about ½ of the length of the predominant wavelength of the microwave energy passing through barrier assembly 970. The diameter of the discs can be at least about 50 percent, at least about 60 percent, at least about 75 percent, at least about 90 percent and/or no more than about 95 percent, no more than about 85 percent, no more than about 70 percent, or no more than about 60 percent of the diameter of one or more adjoining waveguides 975*a,b*.

Each disc of sealed window members 972*a-d* can be operably coupled to respective barrier assembly 970*a-d* in any suitable fashion. In one embodiment, each of sealed window members 972*a-d* can comprise one or more sealing devices flexibly coupled to barrier housing 973 and/or sealed window members 972*a,b*. As used herein, the term "flexibly coupled" means fastened, attached, or otherwise arranged such that the members are held in place without directly contacting one or more rigid structures. For example, in one embodiment shown in FIG. 6*b*, barrier assembly 970 can comprise a plurality of resilient rings 982*a,b* and 984*a,b* compressed between various segments 973*a-c* of and operable to flexibly couple sealed window members 972*a,b* into barrier housing 973.

According to one embodiment, each respective upstream 982*a,b* and downstream 984*a,b* resilient rings can be operable to adequately prevent or limit fluid flow between first and second 973*a,b* and/or second and third 973*b,c* sections of barrier assembly 970. For example, when subjected to a helium leak test according to procedure B1 entitled "Spraying Testing" described in the document entitled "Helium Leak Detection Techniques" published by Alcatel Vacuum Technology using a Varian Model No. 938-41 detector, the fluid leak rate of sealed window members 972*a-d* and/or barrier assemblies 970*a-d* can be no more than about $10^{-2}$ torr liters/sec, no more than about $10^{-4}$ torr liters/sec, or no more than about $10^{-8}$ torr liters/sec. In addition, each of sealed window members 972*a,b* can individually be operable to maintain or withstand a pressure differential across sealed window members 972*a,b* and/or barrier assembly 970 in amounts such as at least about 0.25 atm, at least about 0.5 atm, at least about 0.75 atm, at least about 0.90 atm, at least about 1 atm, or at least about 1.5 atm without out breaking, cracking, shattering, or otherwise failing.

Figure 6C:
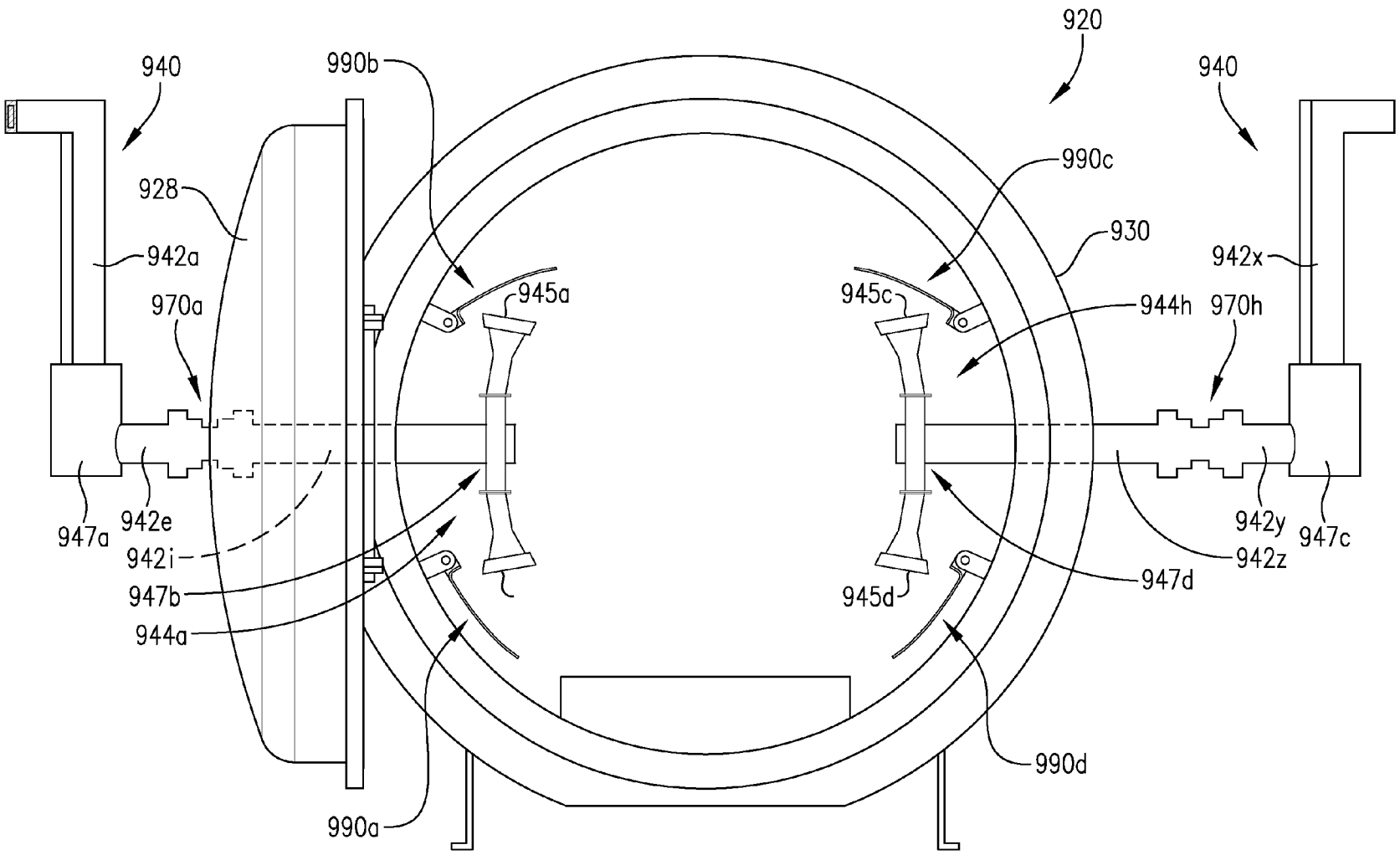
FIG. 6*c* is an end view of the microwave heating system depicted in FIG. 6*a*, particularly illustrating the microwave heater as being equipped with split microwave launchers on opposite sides of the heater and movable reflectors for rastering microwave energy emitted from the split launchers.

Turning now to FIG. 6*c*, a cross-sectional microwave heating system 920 is provided. The microwave heating system depicted in FIG. 6*c* includes a microwave distribution system 940 comprising at least one pair of microwave launchers (e.g., launchers 944*a* and 944*h*) disposed on generally opposite sides of a microwave heater 930. Although shown as including a single pair of launchers in FIG. 6*c*, it should be understood that microwave distribution system 940 can further comprise one or more additional pairs of similarly (or somewhat differently) configured microwave launchers having, in some embodiments, one launcher from each pair disposed on generally opposite sides of microwave heater 930. Further, in another embodiment (not shown in FIG. 6*c*), microwave distribution system 940 may comprise two or more rows vertically-spaced microwave launchers positioned on the generally same side of microwave heater 930. In one embodiment, each side of microwave heater 930 can include two or more vertically-spaced rows of launchers, such that one launcher from each oppositely-disposed pair may be located at a higher vertical elevation than one launcher from another oppositely-disposed pair. For example, in one embodiment, launchers 944*a* and/or 944*h* could be positioned at a slightly higher vertical elevation than depicted in FIG. 6*c* and another launcher pair could be positioned such that one of the two launchers would be positioned on the same side of microwave heater 930, but at a generally lower vertical elevation than launcher 944*a*, and the other launcher would be positioned on the same side of microwave heater 930, but at a generally lower vertical elevation than launcher 944*h*. Furthermore, although shown as split launchers 944*a,h*, the vertically-spaced launchers, in one embodiment, could be any type (or any combination of types) of microwave launchers described herein.

As shown in FIG. 6*c*, microwave distribution system 940 comprises a plurality of waveguide segments 942 coupled to at least one pair of microwave launchers 944*a,h*. For example, as shown in the embodiment in FIG. 6*c*, launcher 944*a* can be coupled to waveguide segments 942*a*, 942*e*, and 942*i*, while launcher 944*h* can be coupled to waveguide segments 942*x*, 942*y*, and 942*z* operable to deliver microwave energy from one or more microwave generators (not shown in FIG. 6*c*) to the interior of microwave heater 930. In one embodiment, microwave distribution system 940 can include one or more mode converters 947*a-d*, as shown in FIG. 6*c*, coupled to one or more of waveguide segments 942. According to one embodiment, mode converters 947*a-d* can be operable to change the transmission mode of the microwave energy passing therethrough from a $TE_{xy}$ mode to a $TM_{ab}$ mode (i.e., a $TE_{xy}$-to-$TM_{ab}$ mode converter) or from a $TM_{ab}$ mode to a $TE_{xy}$ mode (i.e., a $TM_{ab}$-to-$TE_{xy}$ mode converter). For example, as shown in FIG. 6*c*, mode converters 947*a* and 947*c* can each be operable to convert the microwave energy transmitted through waveguides 942*a* and 942*x* from a $TE_{xy}$ mode to a $TM_{ab}$ mode as it passes into waveguides 942*e* and 942*y*. As discussed previously, the values of a, b, x, and y can be the same or different and can have the values provided above. Optionally, mode converters 947*b* and 947*d* can be operable to convert the microwave energy transmitted through waveguides 942*e* and 942*i* as well as the energy transmitted through 942*y* and 942*z* from a $TM_{ab}$ mode to a $TE_{xy}$ mode.

Further, in one embodiment illustrated in FIG. 6*c*, at least one of mode converters 947*a-d* can comprise a mode converter splitter operable both to change the mode of the microwave energy passing therethrough and to split it into two or more separate streams of microwave energy for discharge into the interior space of the microwave heater. According to one embodiment, second mode converters 947*b* and 947*d* can each comprise mode converting splitters at least partially disposed within the interior of microwave heater 930. In another embodiment, second mode converting splitters 947*b* and 947*d* can be entirely disposed within the interior of microwave heater 930 and can each be a part of a split launcher 944*a* and 944*h*, respectively, as illustrated in FIG. 6*c*. Additional details regarding split launchers 944*a,h* will be discussed shortly.

According to one embodiment of the present invention wherein the microwave distribution system 940 comprises two or more mode converters in one or more waveguide segments, the total electrical length between the first and second mode converters, extending through and including the electrical length of any barrier assembly (if present) can be equal to a value that is a non-integral number of half-wavelengths of the competing mode of microwave energy passing therethrough. As used herein, the term "electrical length" refers to the electrical path of transmission of the microwave energy, expressed as the number of wavelengths of the microwave energy required to propagate along a given path. In one embodiment wherein the physical transmission path includes one or more different type of transmission media having two or more different dielectric constants, the physical length of the transmission path can be shorter than the electrical length. Thus, electrical length depends on a number of factors including, for example, the specific wavelength of microwave energy, the thickness and type (e.g., dielectric constant) of the transmission medium or media.

According to one embodiment, the total electrical length between the first mode converter 947*a,c* and the second mode converter 947*b,d* extending through and including the total electrical length of the $TM_{ab}$ barrier assembly 970*a,h* can be equal to a non-integral number of half-wavelengths of the competing mode of microwave energy. As used herein, the term "non-integral" refers to any number that is not a whole number. A non-integral half-wavelength, then, may correspond to a distance of n times $\lambda/2$, wherein n is any non-integral number. For example, the number "2" is a whole number, while the number "2.05" is a non-integral number. Thus, an electrical length corresponding to 2.05 times the half-wavelength of the competing mode of microwave energy would be a non-integral number of half-wavelengths of that competing mode.

As used herein, the term "competing mode of microwave energy" refers to any mode of microwave energy propagating along a given path other than the desired or target mode of microwave energy intended for propagation along that path. The competing mode may include a single, most prevalent mode (i.e., the predominant competing mode) or a plurality of different, non-prevalent competing modes. When multiple competing modes are present, the total electric length between the first and second mode converters, extending through and including the electrical length of any barrier assembly (if present), can be equal to a value that is a non-integral number of half-wavelengths of at least one of the multiple competing modes and, in one embodiment, can be equal to a value that is a non-integral number of half-wavelengths of the predominant competing mode.

For example, in one embodiment depicted in FIG. 6*c*, first mode converters 947*a,c* comprise $TM_{ab}$ mode converters operable to convert at least a portion of the microwave energy in respective waveguide segments 942*a* and 942*d* from a $TE_{xy}$ mode into a $TM_{ab}$ mode in waveguide segments 942*b* and 942*e*. However, in practice, at least a portion of the microwave energy may be converted into a mode other than the desired mode. Any mode other than the desired mode is generally referred to herein as the "competing mode" of microwave energy. In one embodiment of the present invention wherein the desired mode of microwave energy is a $TM_{ab}$ mode, the competing mode of microwave energy may be a $TE_{mn}$ mode, wherein n is 1 and m is an integer between 1 and 5. Thus, in one embodiment, the total electrical length of the $TM_{ab}$ waveguides 942*e* and 942*i* between first and second mode convertors 947*a* and 947*b*, extending through and including the electrical length of barrier assembly 970*a*, can be equal to a non-integral number of half-wavelengths of the $TE_{mn}$ mode, wherein n is 1 and m is an integer between 1 and 5. In another embodiment, m can be 2 or 3.

In one embodiment, selecting physical lengths and properties of waveguide segments 942, mode converters 947*a-d*, and/or barrier assemblies 970*a,h* can minimize energy concentration within barrier assemblies 970*a,h*. For example, according to one embodiment, while at least about 5 kW, at least about 30 kW, at least about 50 kW, at least about 60 kW, at least about 65 kW, at least about 75 kW, at least about 100 kW, at least about 150 kW, at least about 200 kW, at least about 250 kW, at least about 350 kW, at least about 400 kW, at least about 500 kW, at least about 600 kW, at least about 750 kW, or at least about 1,000 kW and/or not more than about 2,500 kW, not more than about 1,500 kW, or not more than about 1,000 kW of energy can be passed through barrier assemblies 970*a,h*, the temperature of at least a portion of at least one sealed window member within barrier assemblies 970*a,h* (not shown in FIG. 6*c*) can change by no more than about 10° C., no more than about 5° C., no more than about 2° C. or no more than about 1° C. In another embodiment, the pressure differential across the at least one sealed window member and/or the pressure within microwave heater 930 can be maintained as described above with similar results.

According to one embodiment illustrated in FIG. 6*c*, at least one of the individual microwave launchers 944*a,h* located on generally opposite sides of and at least partially disposed within the interior of microwave heater 930 can comprise a split launcher defining at least two discharge openings for emitting microwave energy into the interior of microwave heater 930. Although illustrated as comprising a single pair (e.g., a first split launcher 944*a* and a second split launcher 944*h*) of launchers in FIG. 6*c*, it should be understood that microwave heater 930 can comprise any suitable number of launchers or pairs of launchers, as described herein.

Figure 6E:
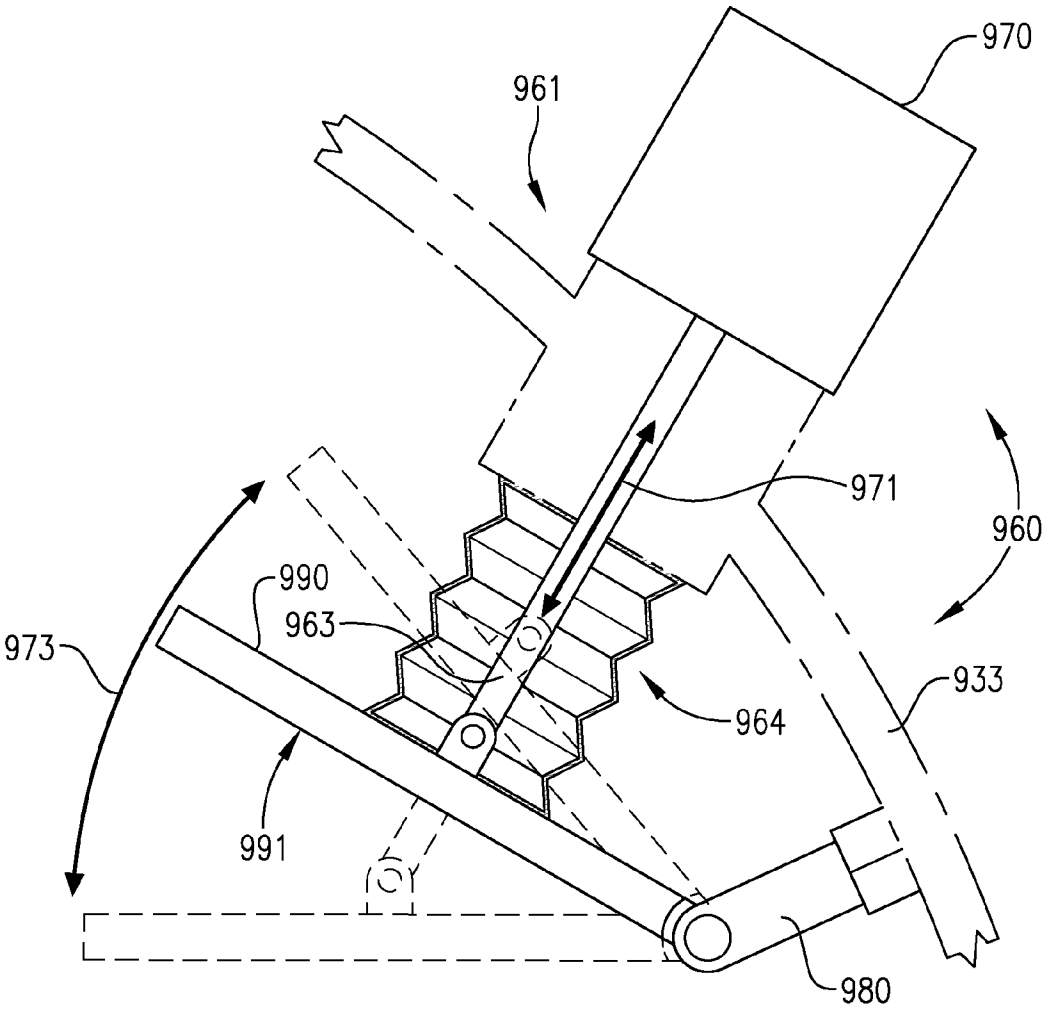
FIG. 6*e* is an enlarged view of one embodiment of a system for moving a reflector, particularly illustrating an actuator used to cause oscillation of the reflector and a bellows for inhibiting fluid leakage at the location where the actuator penetrates the wall of the microwave heater.
Figure 6D:
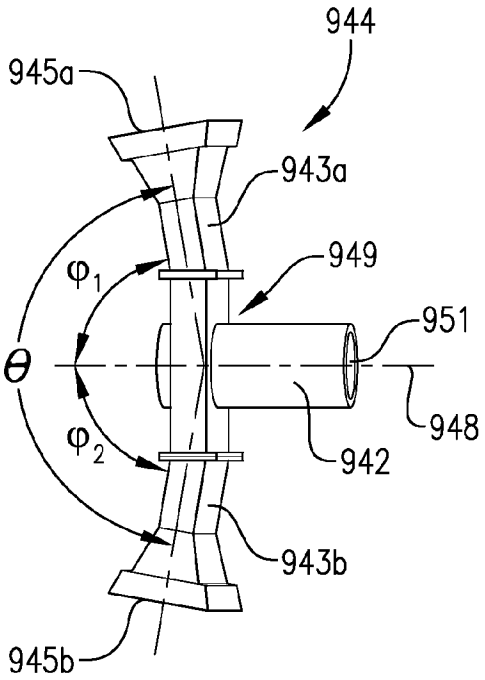
FIG. 6*d* is an enlarged side view of one of the split launchers depicted in FIG. 6*c*, particularly illustrating the launch angle for the two separate microwave energy fractions emitted from the split launcher.

One embodiment of a split launcher 944 is depicted in FIG. 6*d*. Split launcher 944 can comprise a single inlet or openings 951 for receiving microwave energy and a single (not shown) or two or more discharge openings, or outlets, 945*a,b* for emitting microwave energy therefrom. In one embodiment, the ratio of microwave energy inlets to discharge outlets for a single split launcher can be 1:1, at least 1:2, at least 1:3, or at least 1:4. According to one embodiment, the mode of the microwave energy introduced into inlet 951 can be the same as the mode of the microwave energy emitted via discharge openings 945*a,b*, while, in another embodiment, the modes can be different. For example, in one embodiment wherein split launcher 944 comprises a mode converting splitter 949, the microwave energy introduced into a single inlet of a first sidewall of a microwave heater can undergo a mode conversion and be divided into at least two separate microwave energy portions, which can subsequently be emitted into the interior of the heater, optionally in a different mode. For example, in one embodiment shown in FIG. 6*d*, split launcher 944 can comprise a $TM_{ab}$ waveguide segment 942, one or two or more $TE_{xy}$ waveguide segments 943*a,b* and a $TM_{ab}$ to $TE_{xy}$ mode converting splitter 949 disposed therebetween. In operation, microwave energy in a $TM_{ab}$ mode introduced via waveguide segment 942 passes through mode converting splitter 949 before being discharged, simultaneously or nearly simultaneously, in one or two or more separate fractions of microwave energy from respective outlets 945*a,b* of waveguides 943*a,b* in a $TE_{xy}$ mode.

When launcher 944 comprises a single discharge opening, mode converting splitter 949 can simply be a mode converter 949 (not a splitter) for changing the mode of the microwave energy passing therethrough. For example, in one embodiment wherein launcher 944 comprises a single discharge opening (not shown in FIG. 6*d*), launcher 944 can comprise a single $TM_{ab}$ waveguide segment, a single $TE_{xy}$ waveguide segment, and a $TM_{ab}$-to-$TE_{xy}$ mode converter 949 disposed therebetween. The mode converter can be located outside, partially inside, or completely inside the interior of the microwave heater. In operation, microwave energy in a $TM_{ab}$ mode introduced via the inlet waveguide segment can pass through mode converter 949 before being discharged in a $TE_{xy}$ mode. The discharge opening of the single-opening launcher can be oriented at any suitable angle with respect to the horizontal or can be substantially parallel to the horizontal. In one embodiment, the energy discharged from the single-opening launcher can be oriented from the horizontal by an angle of at least about 20°, at least about 30°, at least about 45°, or at least about 60° and/or not more than about 100°, not more than about 90°, or not more than about 80°.

When multiple discharge openings are present, each of discharge openings 945*a,b* of split launcher 944 can be oriented from each other such that the paths of microwave energy discharged therefrom define a relative angle of discharge, Θ, as shown in FIG. 6*d*. In one embodiment, the relative angle of discharge between the paths of microwave energy discharge openings 945*a,b* can be at least about 5°, at least about 15°, at least about 30°, at least about 45°, at least about 60°, at least about 90°, at least about 115°, at least about 135°, at least about 140° and/or no more than about 180°, no more than about 170°, no more than about 165°, no more than about 160°, no more than about 140°, no more than about 120°, no more than about 100°, or no more than about 90°. In one embodiment, the orientation of discharge openings 945*a,b* can also be described with respect to the orientation of the paths of the microwave energy discharged therefrom relative to the axis of extension 948 of $TM_{ab}$ waveguide segment 942. In one embodiment, each of discharge openings 945*a,b* can be configured to discharge microwave energy at respective first and second discharge angles ($\phi_1$ and $\phi_2$) from the axis of extension 948 of $TM_{ab}$ waveguide segment 942. In one embodiment, $\angle_1$ and $\phi_2$, can be approximately equal, as generally depicted in FIG. 6*d*, or, in another embodiment, one of the two angles can be larger than the other. In various embodiments, $\phi_1$ and/or $\phi_2$ can be at least about 5°, at least about 10°, at least about 15°, at least about 30°, at least about 35°, at least about 55°, at least about 65°, at least about 70° and/or no more than about 110°, no more than about 100°, no more than about 95°, no more than about 80°, no more than about 70°, no more than about 60°, or no more than about 40°.

In one embodiment, split launcher 944 can be a vertically-oriented split launcher such launcher 944 comprises at least one upward-oriented discharge opening (e.g., 945*a*) configured to emit microwave energy at an upward angle from the horizontal and at least one downward-oriented discharge opening (e.g., 945*b*) configured to emit microwave energy at a downward angle from the horizontal. Although depicted in FIG. 6*c* as comprising vertically-oriented split launchers 944*a,h* configured to discharge energy at angles relative to the horizontal, in another embodiment, one or more of split launchers 944*a,h* of microwave heater 930 can be horizontally-oriented, such that the split launcher, as described above, has been are rotated by 90°. In another embodiment, one or more split launchers 944*a,h* can be rotated by an angle between 0° and 90°. In one embodiment (not shown), a microwave heater can include two or more vertically-spaced rows of horizontally-oriented split launchers located on one side of the heater and two or more vertically-spaced rows of horizontally-oriented split launchers on the other, generally opposite side of the same heater. According to this embodiment, the vertically-spaced rows of launchers can comprise single-opening launchers, horizontally-oriented split launchers, vertically-oriented split launchers, or any combination thereof.

In one embodiment shown in FIG. 6*c*, microwave heater 930 can comprise one or more (or at least two) movable reflectors 990*a-d* positioned at various locations within microwave heater 930 and configured to raster microwave energy emitted from one or more discharge openings 945*a-d* of one or more microwave launchers 944*a,h* into the interior of microwave heater 930. Reflectors 990*a-d* can have any suitable configuration, such as, for example, configurations including one or more of the features previously described with respect to FIGS. 5*f-h*. Further, although generally illustrated as comprising four movable reflectors 990*a-d*, it should be understood that microwave heater 930 can comprise any suitable number of movable reflectors. In one embodiment, a microwave heater comprising n split launchers can comprise at least 2n movable reflectors. In another embodiment, a microwave heater can employ a total of four movable reflectors, each defining a reflector surface that extends substantially along the length of microwave heater 930, such that two or more axially adjacent launchers "share" one or more reflectors or reflecting surfaces.

Regardless of the specific number of reflectors employed, each reflector 990*a-d* can be operable to raster at least a portion of the microwave energy exiting launchers 944*a,h* via discharge openings 945*a-d* into microwave heater 930 to thereby heat and/or dry at least a portion of the object, article, or load. As used herein, the term "raster" means to direct, project, or concentrate energy over a certain area. In contrast to conventional reflecting or dispersing energy, rastering energy involves a greater degree of intentional directing or concentrating, which can be accomplished by utilizing the quasi-optical properties of microwave energy. In contrast to conventional means, rastering does not include use of stationary reflection surfaces or conventional mode stirring devices, such as fans. In one embodiment, the microwave heater can comprise a plurality of split launcher pairs (e.g., two or more pairs of launchers), wherein each pair comprises two launchers having substantially similar configurations (as described above). In one embodiment, one launcher of each pair can be positioned on generally opposite sides or on the same side of the microwave heater, as discussed in detail previously, with respect to FIGS. 5*c* and 5*d*. According to one embodiment, one or more movable reflectors 990*a-d* can be positioned near (and/or positioned to face) one or more discharge openings of each of microwave launchers 944. In one embodiment wherein first and second launchers 944*a* and 944*h* each comprise split microwave launchers defining respective upward-oriented discharge openings 945*a* and 945*c* and respective downward-oriented discharge openings 945*b* and 945*d*, at least one movable reflector can be positioned near one or more of discharge openings 945*a-d* to raster at least a portion of the microwave energy discharged from split launchers 944*a,h* (e.g., two or more separate $TE_{xy}$ mode microwave portions) into the interior of microwave heater 930. In one embodiment illustrated in FIG. 6*c*, microwave heater 930 can comprise at least four movable reflectors, each defining a respective reflecting surface and positioned near respective discharge openings 945*a-d* of split launchers 944*a,h*. As illustrated in FIG. 6*c*, movable reflectors 990*a-d* can be located in the bottom left quadrant (e.g., reflector 990*a*), the top left quadrant (e.g., reflector 990*b*), the top right quadrant (e.g., reflector 990*c*), and the bottom right quadrant (e.g., reflector 990*d*) of microwave heater 930. Two or more of reflectors 990*a-d* can also be present when launchers 944*a,h* are horizontally-oriented split launchers or single-opening launchers, as described in detail previously.

Movable reflectors 990*a-d* can be configured in two vertically-spaced pairs (e.g., reflector 990*a* paired with reflector 990*b* and reflector 990*c* paired with reflector 990*d*) and/or in two horizontally-spaced pairs (e.g., reflector 990*b* paired with reflector 990*c* and reflector 990*a* paired with reflector 990*d*). As illustrated in FIG. 6*c*, pairs of vertically-spaced reflectors (e.g., reflector pair 990*a,b* and 990*c,d*) can be positioned near split launchers 944*a,h* such that one movable reflector is positioned near each of discharge openings 945*a-d* of launchers 944*a,h* (e.g., discharge openings 945*a-d* face towards respective movable reflectors 990*a-d*). As depicted in FIG. 6*c*, movable reflectors 990*b* and 990*c* can be positioned at a higher vertical elevation than respective movable reflectors 990*a* and 990*d*, such that split launchers 944*a,h* can be vertically positioned between vertically-spaced pairs of launchers (e.g., launcher 944*a* vertically positioned between vertically-spaced pair of reflectors 990*a,b* and launcher 944*h* vertically positioned between vertically-spaced pair of reflectors 990*c,d*). In one embodiment, movable reflector 990 is positioned such that reflector surface 991 faces toward an open outlet of its corresponding microwave launcher (not shown). In another embodiment, one or more movable reflectors 990*a-d* can be positioned in alignment with or positioned to face the central axis of elongation of microwave heater 930 (not shown in FIG. 6*c*).

Movable reflectors 990*a-d* can be directly or indirectly coupled to one or more side walls of a microwave heater and can be moved or actuated in any suitable fashion. One or more of the reflectors 990*a-d* can move along a pre-programmed (planned) path, or one or more can be caused to move in a random or non-repeating pattern. When multiple reflectors 990*a-d* are present, two or more reflectors 990*a-d* can have the same or similar pattern of movement, in one embodiment, while, in the same or another embodiment, two or more reflectors 990*a-d* can have different patterns of movement. According to one embodiment, at least one of reflectors 990*a-d* can move in a generally arcuate-shaped path and can pass through various segments or "regions" of the overall path with a certain speed and/or residence time. The size and number of regions, as well as the speed with which the reflector moves through each region or the reflector residence time in each region depend on a variety of factors, such as for example, the size and type of the articles to heated, as well as the preliminary and desired characteristics of the initial and final dried and/or heated articles.

In one embodiment, each of reflectors 990*a-d* can be individually driven or actuated according to one or more embodiments described herein, while, in another embodiment, two or more reflectors can be connected to a common drive mechanism (e.g., rotating shaft to be actuated at the same time. One example of a drive mechanism for moving a reflector 990 using an actuator 960 is shown in FIG. 6*e*. Actuator 960 can be a linear actuator having a fixed portion 961 coupled to a sidewall 933 of the microwave heater and an extensible portion 963 connected to a movable reflector 990. According to one embodiment illustrated in FIG. 6*e*, at least part of fixed portion 961 can extend through external side wall 933 and into a bellows structure 964, thereby sealingly coupling actuator 960 to side wall 933. In one embodiment, bellows structure 964 can be operable to reduce, minimize, or nearly prevent fluid flow into or out of the location where actuator 960 extends through side wall 933. As shown in FIG. 6*e*, movable reflector 990 further comprises a support arm 980 pivotally coupled to side wall 933 of the microwave heater. As used herein, the term "pivotally coupled" refers to two or more objects attached, fastened, or otherwise associated such that at least one of the objects can generally move or pivot about a fixed point. In operation, a driver 970 moves extensible portion 963 of linear actuator 960 in an in-and-out type motion, as indicated by arrow 971. Extensible portion 963 of linear actuator 960 allows movable reflector 990 to move in a generally arcuate pattern, as indicated by arrow 973. Driver 970 can be controlled in any suitable manner, including, for example, using one or more programmable automatic control systems (not shown).

One or more embodiments of the operation of a microwave heating system according to the present invention will now be described. Although generally described below, it should be understood that one or more of the above-described embodiments of microwave heating systems, including those discussed with respect to FIGS. 4-6 and variations thereof, can be operated using at least some, or all, of the operational steps, methods, and/or processes described in detail below.

Turning now to FIGS. 7*a* and 7*b*, schematic top views of a microwave heating system 1020 configured according to one embodiment of the present invention are provided. Microwave heating system 1020 is illustrated as comprising at least four microwave generators 1022*a-d* for producing microwave energy and a microwave distribution system 1040 for directing at least a portion of the microwave energy into a microwave heater 1030. Microwave distribution system 1040 also comprises a plurality of spaced microwave launchers 1044*a-h* (which, in one embodiment, can comprise one or more split launchers) operable to emit at least a portion of microwave energy into the interior of microwave heater 1040. Each of microwave launchers 1044*a-h* can be operably coupled to one or more of a plurality of (in this figure, a first through fourth) microwave switches 1046*a-d*, as shown in FIGS. 7*a* and 7*b*. Microwave switches 1046*a-d* can be operable to route microwave energy to one or more of launchers 1044*a-h* in any suitable mode including, for example, a $TM_{ab}$ mode and/or a $TE_{xy}$ mode, as discussed in detail previously. In one embodiment, the energy propagated through microwave distribution system 1040 can change modes at least once prior to being discharged into microwave heater 1030. Various configurations and methods of operating microwave heating system 1020 according to one or more embodiments of the present invention will now be described in detail below, with reference to FIGS. 7*a* and 7*b*.

Each of microwave switches 1046*a-d* can be operable to direct, control, or allocate the flow of microwave energy to each of two or more microwave launchers 1044*a-h* positioned on generally the same side or generally opposite sides of microwave heater 1030. For example, in one embodiment depicted in FIG. 7*a*, each of microwave switches 1046*a-d* can be coupled to a pair of axially adjacent microwave launchers (e.g., launchers 1044*a* and 1044*b*, launchers 1044*c* and 1044*d*, launchers 1044*e* and 1044*f*, and launchers 1044*g* and 1044*h*), represented as launcher pairs 1050*a-d*. In another embodiment illustrated in FIG. 7*b*, each of microwave switches 1046*a-d* can be coupled to a pair of axially aligned microwave launchers (e.g., launchers 1044*a* and 1044*h*, launchers 1044*b* and 1044*g*, launchers 1044*c* and 1044*f*, and launchers 1044*d* and 1044*e*), shown as launcher pairs 1050*e-h*.

Microwave switches 1046*a-d* can be any suitable type of microwave switch and, in one embodiment, can be a rotary microwave switch. A rotary microwave switch can include an outer housing, an internal routing element disposed therein, and an actuator for moving the internal routing element within the housing. In one embodiment, the internal routing element can be rotatably coupled to the outer housing and the actuator can be operable to selectively rotate the internal routing element, relative to the outer housing, to thereby switch or direct the direction of flow of the microwave energy passing therethrough. Other types of suitable microwave switches can also be employed. In one embodiment, microwave switches 1046*a-d* can comprise $TE_{xy}$ switches, while, in another embodiment, microwave switches 1046*a-d* can comprise $TM_{ab}$ switches. Any additional suitable components, such as one or more mode converters, barrier assemblies, or components discussed elsewhere in this application but not shown in FIGS. 7*a* and 7*b*, can be located upstream or downstream microwave switches 1046*a-d*.

In operation, microwave switches 1046*a-d* can be selectively switchable between a first heating (or discharge) phase and a second heating (or discharge) phase. During the first heating phase, more energy can be emitted or discharged from one or more microwave launchers, while less energy is emitted from one or more other microwave launchers. Similarly, during the second heating phase, more energy can be emitted or discharged from one or more other microwave launchers, while less energy can be emitted or discharged from one or more microwave launchers.

In one embodiment, during the first heating phase, each of microwave switches 1046*a-d* can be configured to route microwave energy predominantly to one or more launchers within a first set of microwave launchers (labeled as set of "A" launchers in FIGS. 7*a* and 7*b*) and not predominantly to one or more launchers of a second set of microwave launchers (labeled as a set of "B" launchers in FIGS. 7*a* and 7*b*). During the second discharge phase, each of microwave switches 1046*a-d* can be configured to route microwave energy predominantly to one or more launchers of the second set (e.g., the "B" launchers) and not predominantly to one or more launchers of the first set (e.g., the "A" launchers) in each of respective pairs of launchers 1050*a-d* and 1050*e-h*, in FIGS. 7*a* and 7*b*. As used herein, references to routing microwave energy "predominantly" to launcher X and "not predominantly" to launcher Y means that at least about 50 percent of the microwave energy received by a switch is routed to launcher X, while no more than about 50 percent of the microwave energy received by the switch is routed to launcher Y. In one embodiment, for example at least about 75 percent, at least about 90 percent, at least about 95 percent, substantially all of the energy can be predominantly routed to launcher X, while, for example no more than about 25 percent, no more than about 10 percent, no more than about 5 percent or substantially none of the energy can be routed to launcher Y.

In one embodiment, microwave heating system 1030 can further comprise a control system 1060 for controlling the action and configuration of microwave switches 1046*a-d*. In one embodiment, control system 1060 can be operable to configure each of switches 1046*a-d* to be in the first discharge phase, such that all "A" launchers (e.g., launchers 1044*a,c,e,g*) emit microwave energy into microwave heater 1030, while all "B" launchers (e.g., launchers 1044*b,d,f,h*) emit a smaller amount of, or substantially no microwave energy into the interior of microwave heater 1030, as illustrated by the respective shaded and un-shaded regions of microwave heater 1030 in FIGS. 7*a* and 7*b*. Subsequently, control system 1060 can then be operable to configure each of switches 1046*a-d* to be in the second discharge phase, such that all "A" launchers (e.g., launchers 1044*a,c,e,g*) emit a smaller amount of, or substantially no microwave energy into the interior of microwave heater 1030, while all "B" launchers (e.g., launchers 1044*b,d,f,h*) emit microwave energy into the interior of microwave heater 1030 (not represented in FIGS. 7*a* and 7*b*).

According to one embodiment, control system 1060 can also be operable to control the switching of microwave switches 1046*a-d* between the first and second discharge phases based on a set of predetermined parameters including, for example, cycle time, total energy discharged, and the like. For example, in one embodiment, control system 1060 can be operable to configure each of microwave switches 1046*a-d* into the first discharge phase substantially simultaneously, such that microwave energy can be emitted from each of the "A" launchers 1044*a,c,e,g* simultaneous for a period of time. In another embodiment, control system 1060 can be operable to include a time delay or lag between configuring one or more switches 1046*a-d* into the first discharge phase. As a result, the microwave energy emitted from one or more "A" or "B" launchers may be delayed or staggered, relative to the discharge of energy from one or more other "A" or "B" launchers. In one embodiment, control system 1060 may be configured to allow one or more switches 1046*a-d* to be in the first discharge phase, while one or more other switches 1046*a-d* are in the second discharge phase, such that microwave energy can be emitted from one or more "A" launchers and one or more "B" launchers simultaneously. In one embodiment of the present invention, control system 1060 can also be operable to at least partially prevent simultaneous energy discharge from directly opposed pairs of launchers (e.g., pair 1044*a* and 1044*h*, pair 1044*b* and 1044*g*, pair 1044*c* and 1044*f*, pair 1044*d* and 1044*e*) and/or axially adjacent pairs (e.g., pair 1044*a* and 1044*b*, pair 1044*c* and 1044*d*, pair 1044*e* and 1044*f*, pair 1044*g* and 1044*h*).

Heating systems configured and/or operated according to one embodiment of the present invention can be operable to heat an object or load more efficiently than conventional heating systems. In particular, heating systems configured according to various embodiments of the present invention can be operable to process large, commercial-scale loads. In one embodiment, heating systems as described herein can heat one or more objects, articles, or other type of load having a cumulative, pre-heating (or pre-treatment) weight of at least about 100 pounds, at least about 500 pounds, at least about 1,000 pounds, at least about 5,000 pounds, or at least about 10,000 pounds.

The various aspects of the present invention can be further illustrated and described by the following Examples. It should be understood, however, that these Examples are included merely for purposes of illustration and are not intended to limit the scope of the invention, unless otherwise specifically indicated.

EXAMPLES

Example 1

Figure 8A:
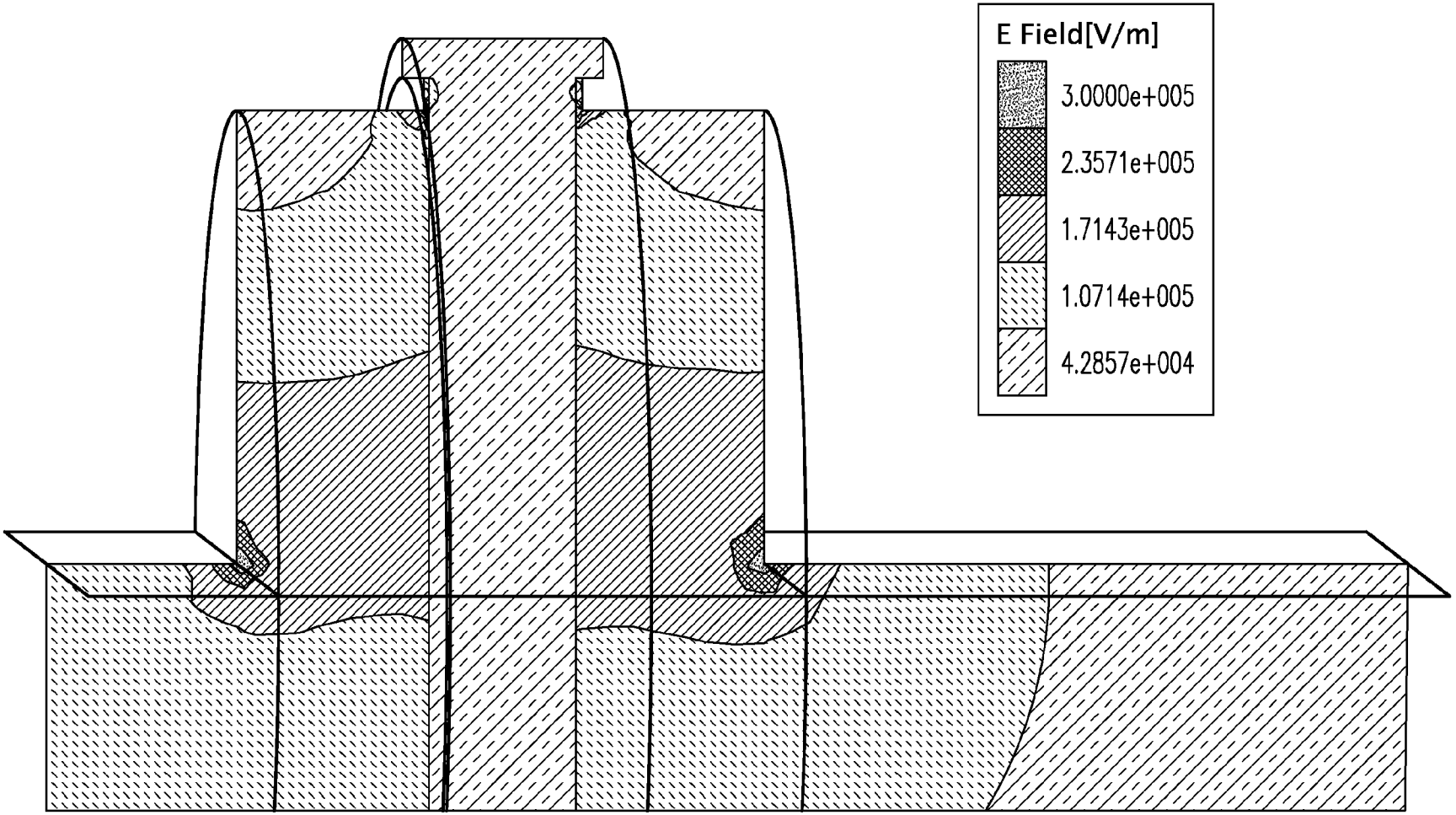
FIG. 8*a* presents results of a computer simulation predicting the peak electric field strengths for a $TE_{10}$ barrier assembly.
Figure 8B:
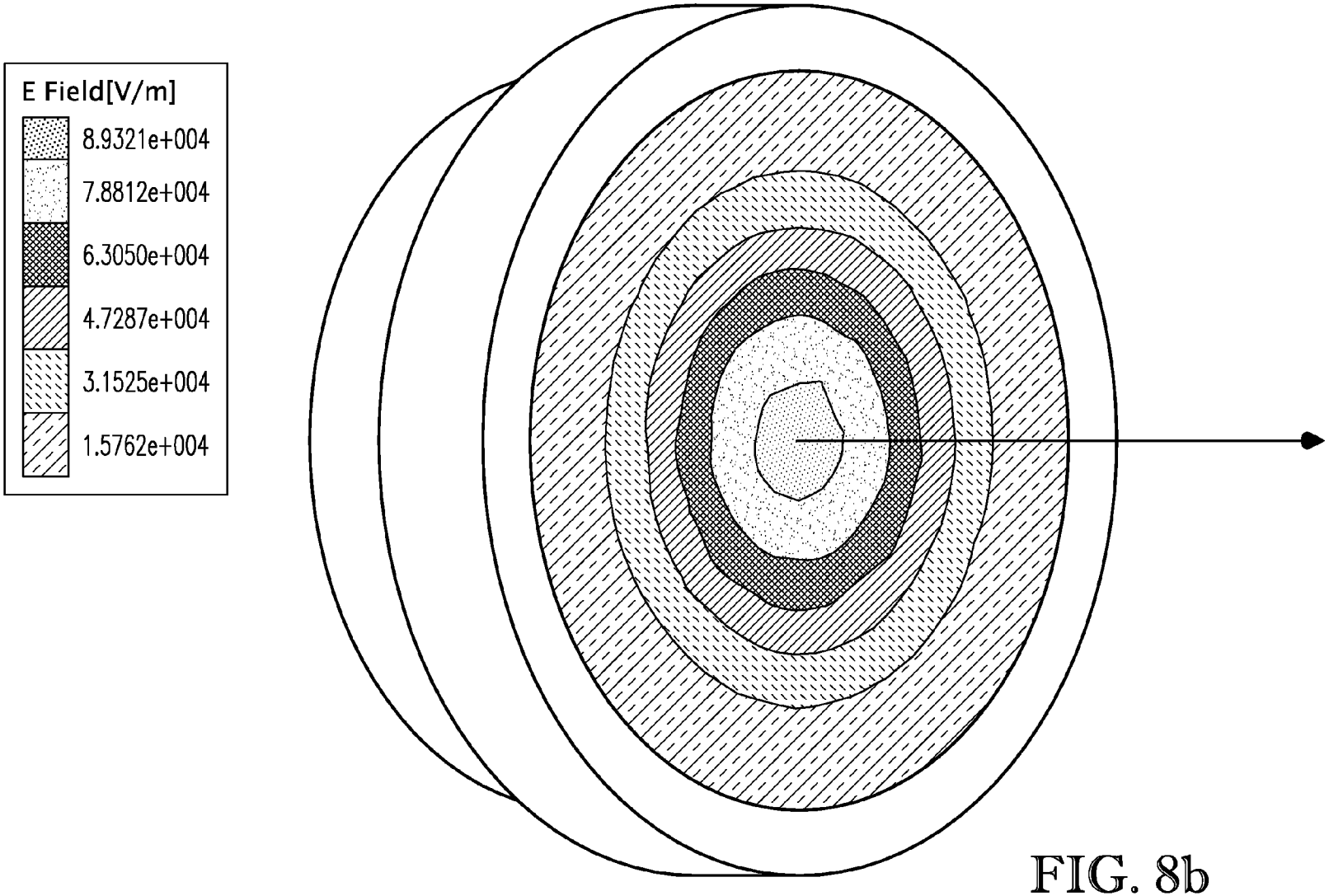
FIG. 8*b* presents results of a computer simulation predicting the peak electric field strengths for a $TM_{01}$ barrier assembly.

Comparison of Electric Field Strengths for a $TE_{10}$ and a $TM_{01}$ Barrier Assembly This example provides results of a simulation conducted to determine the differences between the electric field strengths and energy densities of a $TE_{10}$ barrier assembly and a $TM_{01}$ barrier assembly. Each assembly was modeled using HFSS™ software (available from Ansys in Canonsburg, Pa.). FIGS. 8*a* and 8*b* present schematic depictions of the results of the simulation, particularly illustrating the strength of the electric fields within the comparative $TE_{10}$ assembly in FIG. 8*a* the inventive $TM_{01}$ assembly in FIG. 8*b*.

As shown in FIGS. 8*a* and 8*b*, the peak electric field strength at 75 kW for the inventive $TM_{01}$ barrier assembly (0.9 kV/cm) is approximately one-third of the peak electric field strength of the comparative $TE_{10}$ barrier assembly (3 kV/cm) measured at 75 kW. Consequently, the peak energy density of the $TM_{01}$ barrier assembly is about one-ninth of the peak power density of the $TE_{10}$ barrier assembly.

Example 2

Determination of Breakdown Pressure and Maximum Energy Levels obtainable in $TE_{10}$ and a $TM_{01}$ Barrier Assemblies This example compares the breakdown pressure, at different levels of microwave energy, achievable by both a $TE_{10}$ and a $TM_{01}$ barrier assembly. As shown herein, the $TM_{01}$ barrier assembly is able to operate at lower levels of vacuum at a given energy level and/or permit higher levels of microwave energy to pass through at a given vacuum level than the $TE_{10}$ barrier assembly.

Figure 9:
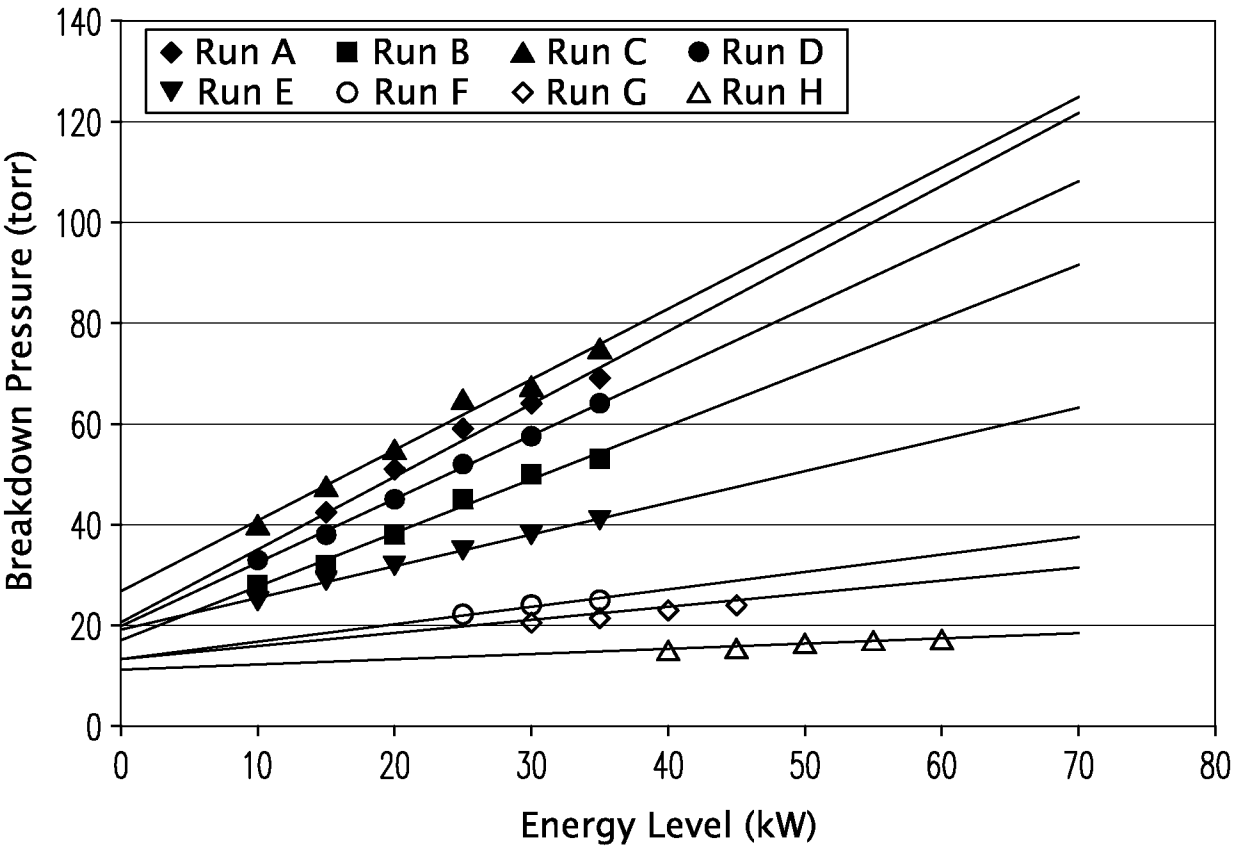
FIG. 9 is a graphical comparison of breakdown pressure as a function of energy level within both a $TE_{10}$ and a $TM_{01}$ microwave barrier assembly.

A custom-built apparatus for testing the breakdown pressure (i.e., the pressure at which arcing first occurs at a given energy level) within a barrier assembly at various pressures and energy levels was constructed in a testing facility. The apparatus included a microwave generator coupled to a set of $TE_{10}$ waveguides operable to receive and hold a removable barrier assembly therebetween. The apparatus included a gas system for introducing different gases at various temperatures into the barrier assembly prior to testing and a vacuum system for controlling the pressure within the assembly during testing. The apparatus also included an automatic arc detection and shut-off system for stopping the microwave generator when arcing was sensed within the assembly. Various test runs (Runs A-H) were conducted to measure the breakdown pressure of both a $TE_{10}$ and a $TM_{01}$ barrier assembly at various energy levels. Table 1, below, summarizes the conditions of each of Runs A-H, while FIG. 9 provides a graphical representation of the breakdown pressures measured, as a function of energy level, for each of Runs A-H.

TABLE 1

Summary of Test Runs to Determine Breakdown Pressures

| Run | Barrier Assembly (Mode) | Gas Type | Gas Temperature, ° C. |
|---|---|---|---|
| A | $TE_{10}$ | Air | 99 |
| B | $TE_{10}$ | Air | 22 |
| C | $TE_{10}$ | Nitrogen | 100 |
| D | $TE_{10}$ | Nitrogen | 22 |
| E | $TE_{10}$ | Acetic Acid | 95 |
| F | $TM_{01}$ | Nitrogen | 90 |
| G | $TM_{01}$ | Nitrogen | 25 |
| H | $TM_{01}$ | Acetic Acid | 90 |

As shown in FIG. 9, for a given energy level, the $TM_{01}$ barrier assembly was operated at a lower pressure (i.e., a higher level of vacuum) than the $TE_{10}$ barrier assembly before arcing occurred. For example, as illustrated by comparing Runs E and H (which both included exposing the barrier assembly to acetic acid at 90 to 95° C.), for a energy level of 20 kW, the minimum operating pressure achievable by the $TE_{10}$ barrier assembly without arcing was 30 torr, while the $TM_{01}$ barrier assembly was able to be operated at or even slightly below 15 torr before arcing occurred. Thus, as illustrated herein, for the same conditions and energy level, the $TM_{01}$ barrier assembly can be exposed to lower pressures without arcing than the $TE_{10}$ barrier assembly.

Alternatively, as also shown in FIG. 9, the $TM_{01}$ barrier assembly was able to operate at a higher energy level than the $TE_{10}$ barrier assembly, at the same pressure and under similar conditions. For example, as evidenced by comparing Runs A and F (which both utilize nitrogen at a temperature of 90 to 99° C.), at a pressure of 40 torr, the $TM_{01}$ barrier assembly could have operated at predicted energy level of about 70 kW without arcing, while the $TE_{10}$ assembly could not be exposed to more than 15 kW of energy before arcing occurred. Further, as indicated by the steeper slope of the breakdown pressure versus energy level curve generated by the $TE_{10}$ assembly, as shown in FIG. 9, it can also be concluded that the vacuum loss (or penalty) for additional increases in energy are greater for the $TE_{10}$ barrier assembly than for the $TM_{01}$ assembly. Thus, the marginal pressure penalty for increasing energy through a $TM_{01}$ barrier assembly is substantially less than for a similarly operated $TE_{10}$ barrier assembly.

The preferred forms of the invention described above are to be used as illustration only, and should not be used in a limiting sense to interpret the scope of the present invention. Obvious modifications to the exemplary one embodiment, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

We claim:

1. A microwave system comprising:

a first $TM_{ab}$ waveguide for transmitting microwave energy in a predominately $TM_{ab}$ mode;

a second $TM_{ab}$ waveguide for transmitting microwave energy in a predominately $TM_{ab}$ mode;

a barrier assembly coupled between said first and second $TM_{ab}$ waveguides and configured to permit passage of microwave energy therethrough in a predominately $TM_{ab}$ mode while inhibiting fluid flow therethrough;

a microwave vessel for receiving microwave energy and for receiving an article to which microwave energy is applied, wherein said second $TM_{ab}$ waveguide extends between said barrier assembly and said microwave vessel; and at least one microwave launcher for receiving microwave energy from said second $TM_{ab}$ waveguide and emitting microwave energy into said microwave vessel, wherein said barrier assembly comprises:

a substantially cylindrical entry section coupled to said first $TM_{ab}$ waveguide and configured to propagate microwave energy in a predominately $TM_{ab}$ mode;

a substantially cylindrical exit section coupled to said second $TM_{ab}$ waveguide and configured to propagate microwave energy in a predominately $TM_{ab}$ mode; and at least one sealed window member disposed between said entry and exit sections, wherein said at least one sealed window member is configured to permit passage of microwave energy therethrough in at predominately $TM_{ab}$ mode while maintaining a pressure differential across said at least one sealed window member, wherein a is 0 and b is in the range of 1 to 5.

2. The microwave system of claim 1, wherein b is 1.

3. The microwave system of claim 1, wherein said at least one sealed window member has a loss tangent of less than $2\times10^{-4}$.

4. The microwave assembly of claim 1, wherein said at least one sealed window member is capable of withstanding a pressure differential of at least 0.5 atm across said at least one sealed window member.

5. The microwave system of claim 1, wherein said at least one sealed window member does not directly contact any rigid structures of said barrier assembly.

6. The microwave system of claim 1, wherein said barrier assembly comprises a first and a second resilient ring compressed against opposite faces of said at least one sealed window member.

7. A barrier assembly for permitting passage of microwave energy therethrough in a predominately $TM_{ab}$ mode while inhibiting fluid flow therethrough, said barrier assembly comprising:

a substantially cylindrical entry section configured to propagate microwave energy in a predominately $TM_{ab}$ mode;

a substantially cylindrical exit section configured to propagate microwave energy in a predominately $TM_{ab}$ mode; and at least one sealed window member disposed between said entry and exit sections, wherein said at least one sealed window member is configured to permit passage of microwave energy therethrough in at predominately $TM_{ab}$ mode while maintaining a pressure differential across said at least one sealed window member, wherein a is 0 and b is in the range of 1 to 5, wherein said barrier assembly has a fluid leak rate of less than $10^{-2}$ torr liters/sec when subjected to a helium leak test.

8. A barrier assembly for permitting passage of microwave energy therethrough in a predominately $TM_{ab}$ mode while inhibiting fluid flow therethrough, said barrier assembly comprising:

a substantially cylindrical entry section configured to propagate microwave energy in a predominately $TM_{ab}$ mode;

a substantially cylindrical exit section configured to propagate microwave energy in a predominately $TM_{ab}$ mode; and at least one sealed window member disposed between said entry and exit sections, wherein said at least one sealed window member is configured to permit passage of microwave energy therethrough in at predominately $TM_{ab}$ mode while maintaining a pressure differential across said at least one sealed window member, wherein a is 0 and b is in the range of 1 to 5, wherein said at least one sealed window member has a loss tangent of less than $7.5\times10^{-5}$, wherein said at least one sealed window member is capable of withstanding a pressure differential of at least 0.75 atm across said at least one sealed window member, wherein said barrier assembly has a fluid leak rate of less than $10^{-4}$ ton liters/sec when subjected to a helium leak test.

9. A barrier assembly for permitting passage of microwave energy therethrough in a predominately $TM_{ab}$ mode while inhibiting fluid flow therethrough, said barrier assembly comprising:

a substantially cylindrical entry section configured to propagate microwave energy in a predominately $TM_{ab}$ mode;

a substantially cylindrical exit section configured to propagate microwave energy in a predominately $TM_{ab}$ mode; and at least one sealed window member disposed between said entry and exit sections, wherein said at least one sealed window member is configured to permit passage of microwave energy therethrough in at predominately $TM_{ab}$ mode while maintaining a pressure differential across said at least one sealed window member, wherein a is 0 and b is in the range of 1 to 5, wherein said barrier assembly defines at least one impedance transforming diameter step change proximate at least one of said entry and said exit sections.

10. A barrier assembly for permitting passage of microwave energy therethrough in a predominately $TM_{ab}$ mode while inhibiting fluid flow therethrough, said barrier assembly comprising:

a substantially cylindrical entry section configured to propagate microwave energy in a predominately $TM_{ab}$ mode;

a substantially cylindrical exit section configured to propagate microwave energy in a predominately $TM_{ab}$ mode; and at least one sealed window member disposed between said entry and exit sections, wherein said at least one sealed window member is configured to permit passage of microwave energy therethrough in at predominately $TM_{ab}$ mode while maintaining a pressure differential across said at least one sealed window member, wherein a is 0 and b is in the range of 1 to 5, wherein said barrier assembly comprises a first sealed window member, a second sealed window member, and an intermediate section, wherein said first sealed window member is coupled between said entry section and said intermediate section, wherein said second sealed window member is coupled between said intermediate section and said exit section.

* * * * *